US007725052B2

(12) United States Patent
Hirai et al.

(10) Patent No.: US 7,725,052 B2
(45) Date of Patent: May 25, 2010

(54) ION GENERATING DEVICE AND IMAGE FORMING APPARATUS INCLUDING SAME

(75) Inventors: Masashi Hirai, Katano (JP); Kuniaki Nakano, Kizugawa (JP); Kazuaki Ishikawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 161 days.

(21) Appl. No.: 12/078,754

(22) Filed: Apr. 4, 2008

(65) Prior Publication Data

US 2008/0246828 A1 Oct. 9, 2008

(30) Foreign Application Priority Data

Apr. 5, 2007 (JP) ..... 2007-099908
Apr. 5, 2007 (JP) ..... 2007-099909

(51) Int. Cl.
*G03G 21/18* (2006.01)
*G03G 15/02* (2006.01)

(52) U.S. Cl. ..... 399/115; 399/168; 399/50

(58) Field of Classification Search ..... 399/115, 399/168, 50, 170–173; 347/127–128
See application file for complete search history.

(56) References Cited

U.S. PATENT DOCUMENTS 4,057,723 A * 11/1977 Sarid et al. ..... 250/326
4,322,156 A * 3/1982 Kohyama ..... 399/50
5,276,491 A * 1/1994 Fuma et al. ..... 399/315
2007/0237547 A1* 10/2007 Zona et al. ..... 399/168
2009/0001280 A1* 1/2009 Adachi ..... 250/423 R
2009/0039244 A1* 2/2009 Kagawa et al. ..... 250/281

FOREIGN PATENT DOCUMENTS

| | | |
|---|---|---|
| JP | 61-223758 | 10/1986 |
| JP | 62-286074 | 12/1987 |
| JP | 10-241828 | 9/1998 |
| JP | 2000-348847 | 12/2000 |
| JP | 2002-237368 | 8/2002 |
| JP | 2006-047642 | 2/2006 |

* cited by examiner

*Primary Examiner*—David M Gray
*Assistant Examiner*—Rodney Bonnette
(74) *Attorney, Agent, or Firm*—Nixon & Vanderhye, P.C.

(57) ABSTRACT

An ion generating device provided in an image forming apparatus of the present invention as a charging device for charging before a first transfer, a charging device for charging before a second transfer, or a charge device for charging an electrostatic latent image is arranged such that a discharge electrode can move with respect to a dielectric material and the relative positions of the discharge electrode and the dielectric material can be changed. This makes it possible to provide: a long-life ion generating device whose life has been extended by making effective use of a dielectric material; and an image forming apparatus including the ion generating device.

26 Claims, 14 Drawing Sheets

ION GENERATING DEVICE AND IMAGE FORMING APPARATUS INCLUDING SAME

This Nonprovisional application claims priority under 35 U.S.C. §119(a) on Patent Application Nos. 099908/2007 and 099909/2007 filed in Japan on Apr. 5, 2007, the entire contents of which are hereby incorporated by reference.

FIELD OF THE INVENTION

The present invention relates to an ion generating device that generates ions along with creeping discharge and an image forming apparatus, such as a copier, a facsimile machine, or a printer, which includes the ion generating device.

BACKGROUND OF THE INVENTION

Some image forming apparatuses such as copiers, printers, and facsimile machines employ an electrophotographic method as a recording method, and the market for such image forming apparatuses have been rapidly growing.

Conventionally, in such an image forming apparatus employing an electrophotographic method, ion generating devices have been used as a charging device for charging a photoreceptor or the like, as an electricity-removing device for removing electricity from a photoreceptor or the like, and as a transfer device for transferring a toner image onto a transfer receiving material. Currently mainstream examples of the ion generating devices include corotron or scorotron corona charging devices and roller-type contact charging devices.

However, now that image forming apparatuses have been miniaturized, there is a demand for miniaturization of charging devices. In reality, such ion generating devices as corona charging devices and roller-type contact device described above cannot sufficiently meet the demand for miniaturization.

Specifically, a corona charging device is arranged such that a corona wire is so covered with a case as to be approximately 1 cm away from the case. This makes it difficult to miniaturize the charging device. A roller-type contact charging device also requires a space, albeit not as large as a corona charging device does, in which a roller is disposed.

Studied in response to the demand as an ion generating device capable of charging even in a small space is an ion generating device, referred to also as "solid ion generating device, which uses a creeping discharge element that generates ions along with creeping discharge. Such an ion generating device can greatly reduce the amount of ozone to be generated.

FIG. 16 shows an arrangement of a conventional ion generating device for generating ions along with creeping discharge. As shown in FIG. 16, the ion generating device includes: a dielectric material 101; and a creeping discharge element 104, which has a discharge electrode 103 and an inductive electrode 102 disposed so as to face each other via the dielectric material 101.

Each of the discharge electrode 103 and the inductive electrode 102 is formed by forming an electrode film such as a tungsten electrode film on (a surface of) the dielectric material 101 and shaping the electrode film into a ribbon (stripe) with use of a photolithographic technique or the like.

When an alternating voltage is applied between the discharge electrode 103 and the inductive electrode 102, creeping discharge occurs near the discharge electrode 103, so that ions are generated accordingly. In the case of the ribbon discharge electrode 103, discharge occurs in two edge portions that extend in a longitudinal direction of the ribbon discharge electrode 103.

Further, commonly-used examples of the dielectric material 101 include mica paper made by joining pieces of mica on top of each other with resin. Other usable examples of the dielectric material include raw mica, ceramic, and a resin sheet. However, it is very difficult to obtain raw mica having a large amount of space, and such raw mica is expensive. Further, ceramic is expensive, albeit not as expensive as raw mica. Moreover, ceramic is prone to breakages and cracks. This makes it difficult to shape ceramic into a thin plate.

Conventionally, a creeping discharge element in such an ion generating device or the device has been judged to have reached the end of its life when it becomes unable to ensure uniformity in ion generating ability or when its ion generating ability falls short of an allowable lower limit.

In the case of the dielectric material 101 made of mica paper as shown in FIG. 16, there is a minute hole 106 formed in a space between mica flakes 105. As the accumulated amount of discharge time becomes larger, the minute hole 106 grows larger or comes to contain water. That part of the minute hole 106 which has grown larger or contains water deteriorates in insulation resistance, and therefore becomes incapable of discharging. This makes it impossible to ensure uniformity in discharge, thereby causing nonuniformity in ion generating ability.

Further, when a high voltage is applied to the discharge electrode 103, a strong electric field is formed between the discharge electrode 103 and a part of the dielectric material 101 in contact with the discharge electrode 103. Therefore, as the accumulated amount of discharge time becomes larger, the dielectric material 101 suffers from a change in color (burn-in). When the dielectric material 101 suffers from such a change in color, the dielectric material 101 cannot maintain the required ion generating ability.

As described above, conventionally, the creeping discharge element 104 or the ion generating device has been judged to have reached the end of its life at a point of time where the dielectric material 101 deteriorates.

Examples of prior art documents of an ion generating device including a creeping discharge element include Patent Documents 1 and 2. In order to prevent deterioration from being caused by discharge, Patent Documents 1 and 2 teach that a surface of a discharge electrode and a surface of a dielectric material on which the discharge electrode is provided are coated with an inorganic coating agent. Patent Documents 1 and 2 also teach that: the coating agent performs a function of preventing the discharge electrode from being wearing due to discharge and prevents the dielectric material from deteriorating due to discharge, thereby greatly improving the life of the ion generating device.

[Patent Document 1]

Japanese Unexamined Patent Application Publication No. 237368/2002 (Tokukai 2002-237368; published on Aug. 23, 2006)

[Patent Document 2]

Japanese Unexamined Patent Application Publication No. 47642/2006 (Tokukai 2006-47642; published on Feb. 16, 2006)

However, even in the arrangement, described in Patent Documents 1 and 2, in which the discharge electrode and the dielectric material are coated with the inorganic coating agent, it is hard to say that the life of the ion generating device is sufficiently long. A proposal for a technique for further extending the life of a creeping discharge element or an ion generating device has been expected.

Furthermore, such a conventional ion generating device as described in Patent Documents 1 and 2 has problems with cost of manufacturing and running cost.

That is, in the above arrangement, the discharge electrode 103 and the inductive electrode 102 are formed by forming an electrode film on a surface of the dielectric material 101 and patterning the electrode film with use of a photolithographic technique or the like. This inevitably causes a rise in cost of manufacturing.

Further, in the case of the discharge electrode 103 made by patterning the electrode film, creeping discharge occurs mainly in the edge portions as shown in FIG. 16, so that the amount of space of discharge is small. Therefore, the amount of discharge is small with respect to the alternating voltage applied between the discharge electrode 103 and the inductive electrode 102. In order to ensure the amount of discharge, it is necessary to apply a high alternating voltage to some extent. This causes an increase in power consumption, and shortens the life of an ion generating device or a creeping discharge element by accelerating deterioration of the dielectric material 101, thereby causing a rise in running cost.

SUMMARY OF THE INVENTION

It is a first object of the present invention to provide: a long-life ion generating device whose life has been extended by making effective use of a dielectric material; and an image forming apparatus including the ion generating device.

As a result of diligent studies to attain the foregoing object, the applicant of the present application finally completed the present invention by finding that since ceramic or mica material has low mechanical strength and is hard to be processed, the material is formed so as to have an amount of space larger than necessary for actual charging, and that a large number of undeteriorated areas that can still be used are left at a point of time where a creeping discharge element or an ion generating device is judged to have reached the end of its life.

In order to attain the first object, an ion generating device of the present invention is an ion generating device for generating ions along with creeping discharge, the ion generating device including: a dielectric material; an inductive electrode disposed on a first surface of the dielectric material; a discharge electrode disposed on a second surface of the dielectric material; an alternating voltage applying section for applying an alternating voltage between the inductive electrode and the discharge electrode; and a DC bias voltage applying section for applying a DC bias voltage to the discharge electrode, the discharge electrode and the dielectric material being provided so as to be movable with respect to each other.

According to the foregoing arrangement, the discharge electrode and the dielectric material are provided so as to be movable with respect to each other. Therefore, in cases where an increase in accumulated amount of discharge time causes the aforementioned deterioration in a portion of the dielectric material in contact with the discharge electrode and the deterioration causes a defect in discharge, the portion of the dielectric material in contact with the discharge electrode can be switched to a new area free of deterioration by changing the position of the discharge electrode with respect to the dielectric material.

This makes it possible to efficiently use a dielectric material that has conventionally been wastefully disposed with an undeteriorated area remaining thereon. This makes it possible to extend the life of a creeping discharge element or an ion generating device while using a dielectric material of the same size. Moreover, this makes it possible to reduce the total cost including maintenance cost for replacing the creeping discharge element and the ion generating device.

In order to attain the first object, an image forming apparatus of the present invention is arranged so as to include an ion generating device of the present invention as a pretransfer charging device for giving electric charge to toner carried on a carrier.

By using an ion generating device of the present invention as a pretransfer charging device for giving electric charge to toner carried on a carrier, an image of high quality can be obtained while holding down the total cost.

In order to attain the first object, an image forming apparatus of the present invention is arranged so as to include an ion generating device of the present invention as a toner precharging device for giving electric charge to toner contained in a developing device for developing an electrostatic latent image.

By using an ion generating device of the present invention as a toner precharging device for giving electric charge to toner contained in a developing device for developing an electrostatic latent image, an image of high quality can be obtained while holding down the total cost.

It is a second object of the present invention to provide: an ion generating device easy to manufacture and capable of reducing the value of an alternating voltage to be applied between a discharge electrode and an inductive electrode; and an image forming apparatus including the ion generating device.

In order to attain the second object, an ion generating device of the present invention is an ion generating device for generating ions along with creeping discharge, the ion generating device including: a dielectric material; an inductive electrode disposed on a first surface of the dielectric material; a discharge electrode disposed on a second surface of the dielectric material; an alternating voltage applying section for applying an alternating voltage between the inductive electrode and the discharge electrode; and a DC bias voltage applying section for applying a DC bias voltage to the discharge electrode, the discharge electrode being constituted by a wire electrode member disposed in contact with the second surface of the dielectric material such that both ends of the electrode member in a longitudinal direction of the electrode member are supported outside of the dielectric material.

According to the foregoing arrangement, the discharge electrode is constituted by a wire electrode member disposed in contact with the second surface of the dielectric material such that both ends of the electrode member in a longitudinal direction of the electrode member are supported outside of the dielectric material. This makes it easier to manufacture a creeping discharge element and an ion generating device as compared with a conventional arrangement in which a discharge electrode has been formed directly on a surface of a dielectric material with use of a photolithographic technique. This makes it possible to reduce the cost of manufacturing.

Furthermore, the discharge electrode is in the shape of a wire. This makes it easy to efficiently cause creeping discharge entirely on an outer circumferential surface of the discharge electrode. As compared with a conventional arrangement in which a discharge electrode made by patterning an electrode film is provided, it becomes possible to increase the amount of discharge with respect to the alternating voltage applied between the discharge electrode and the inductive electrode. This makes it possible to decrease the alternating voltage applied between the discharge electrode and the inductive electrode. This makes it possible to save electric power and to extend the life of the ion generating device or the creeping discharge element by inhibiting the dielectric material from deteriorating.

Further, the discharge electrode is not formed directly on the dielectric material. This makes it easy to change the relative positions of the dielectric material and the discharge electrode. This makes it possible to further extend the life of the ion generating device or the creeping discharge element with efficient use of the dielectric material, for example, by switching the position of the discharge electrode with respect to the dielectric material.

With this, manufacturing is made easier than before and the value of an alternating voltage to be applied between the discharge electrode and the inductive electrode is made lower than before, so that the cost of manufacturing and the running cost can be made lower than before.

In order to attain the second object, an image forming apparatus of the present invention is arranged so as to include an ion generating device of the present invention as a pretransfer charging device for giving electric charge to toner carried on a carrier.

By using an ion generating device of the present invention as a pretransfer charging device for giving electric charge to toner carried on a carrier, an image of high quality can be obtained while holding down the cost of manufacturing and the running cost.

In order to attain the second object, an image forming apparatus of the present invention is arranged so as to include an ion generating device of the present invention as a toner precharging device for giving electric charge to toner contained in a developing device for developing an electrostatic latent image.

By using an ion generating device of the present invention as a toner precharging device for giving electric charge to toner contained in a developing device for developing an electrostatic latent image, an image of high quality can be obtained while holding down the cost of manufacturing and the running cost.

Additional objects, features, and strengths of the present invention will be made clear by the description below. Further, the advantages of the present invention will be evident from the following explanation in reference to the drawings.

DESCRIPTION OF THE EMBODIMENTS

The present invention can be used in an electrophotographic image forming apparatus as a charging device for performing (i) pretransfer charging by which a toner image to be formed on an image carrier such as a photoreceptor or an intermediate transfer body is charged before a transfer, (ii) electrostatic latent image charging by which a photoreceptor is charged, or (iii) toner precharging by which charging of toner contained in a developing device is supplemented.

Embodiment 1

An embodiment of the present invention will be described below with reference to FIGS. 1 through 7. The embodiment described below is a specific example of the present invention, and does not limit the technical scope of the present invention.

First, an overall arrangement of an electrophotographic image forming apparatus 100 according to the present embodiment will be described with reference to FIG. 2. The image forming apparatus 100 is a printer of a tandem type and of an intermediate transfer type, and can form a full-color image.

Figure 2:
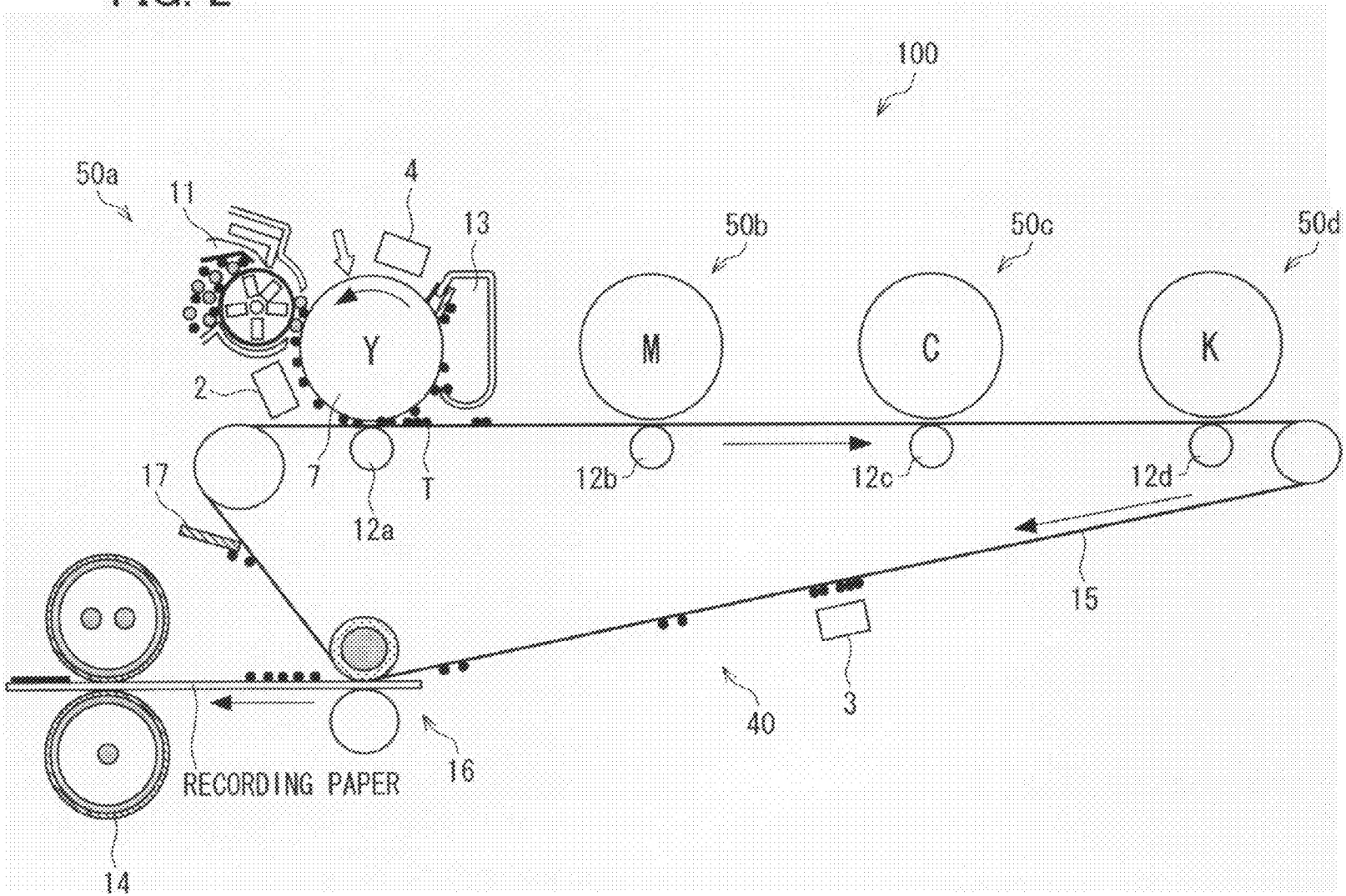
FIG. 2 is an explanatory diagram showing a main part of an image forming apparatus in which such ion generating devices as described above are used as a charging device for a latent image, a charging device for charging before a first transfer, and a charging device for charging before a second transfer.

As shown in FIG. 2, the image forming apparatus 100 includes: four visible-image forming units 50*a* to 50*d* respectively corresponding to four colors (C, M, Y, and K); a transfer unit 40; and a fixing device 14.

The transfer unit 40 includes an intermediate transfer belt 15 (image carrier), four first transfer devices 12*a* to 12*d*, a charging device 3 for charging before a second transfer, a second transfer device 16, and a cleaning device 17 for a transfer. The first transfer devices 12*a* to 12*d*, the charging device 3, the second transfer device 16, and the cleaning device 17 are disposed around the intermediate transfer belt 15.

The intermediate transfer belt 15 is a belt onto which toner images respectively visualized in their respective colors by the visual-image forming unit 50*a* to 50*d* are transferred so as to be superimposed onto one another and from which the toner images thus transferred are retransferred onto a sheet of recording paper. Specifically, the intermediate transfer belt 15 is an endless belt, stretched by a pair of a driving roller and an idling roller, which is driven at the time of image formation to rotate at a predetermined peripheral velocity.

The first transfer devices 12*a* to 12*d* are provided in the visible-image forming units 50*a* to 50*d*, respectively. Each of the first transfer device 12*a* to 12*d* is disposed to face the corresponding one of the visible-image forming units 50*a* to 50*d* with the intermediate transfer belt 15 sandwiched therebetween.

The charging device 3 recharges the toner images so transferred onto the intermediate transfer belt 15 as to be superimposed onto one another.

The second transfer device 16 retransfers, onto the sheet of recording paper, the toner images transferred onto the intermediate transfer belt 15. The second transfer device 16 is provided so as to make contact with the intermediate transfer belt 15. The cleaning device 17 cleans a surface of the intermediate transfer belt 15 from which the toner images have been retransferred.

It should be noted that the first transfer devices 12*a* to 12*d*, the charging device 3, the second transfer device 16, and the cleaning device 17 are disposed around the intermediate transfer belt 15 of the transfer unit 40 in this order from the upstream side of the rotation direction of the intermediate transfer belt 15.

Provided on the downstream side of the second transfer device 16 in the recording-paper conveying direction is the fixing device 14. The fixing device 14 fixes, onto the sheet of recording paper, the toner images transferred onto the sheet of recording paper by the second transfer device 16.

Further provided along the rotation direction of the intermediate transfer belt 15 so as to make contact with the intermediate transfer belt 15 are the four visible-image forming units 50*a* to 50*d*. The visible-image forming units 50*a* to 50*d* are identical in everything but color to one another, and the visible-image forming units 50*a* to 50*d* use yellow (Y) toner, magenta (M) toner, cyan (C) toner, and black toner (K), respectively. In the following, only the visible-image forming unit 50*a* is described, and the other visible-image forming units 50*b* to 50*d* are not described.

The visible-image forming unit 50*a* includes a photosensitive drum (image carrier) 7, a latent image charging device 4, a laser writing unit (not shown), a developing device 11, a charging device 2 for charging before a first transfer, and a cleaning device 13. The charging device 4, the laser writing unit, the developing device 11, the charging device 2, and the cleaning device 13 are disposed around the photosensitive drum 7.

The charging device 4 charges a surface of the photosensitive drum 7 so that the surface of the photosensitive drum 7 has a predetermined potential.

The laser writing unit irradiates (exposes) the photosensitive drum 7 with (to) laser light in accordance with image data received from an external device, scans an optical image on the photosensitive drum 7 that has been uniformly charged, and writes an electrostatic latent image onto the photosensitive drum 7.

The developing device 11 supplies toner to the electrostatic latent image formed on the surface of the photosensitive drum 7, and then forms a toner image by visualizing the electrostatic latent image.

Before the toner image formed on the surface of the photosensitive drum 7 is transferred, the charging device 2 recharges the toner image.

The cleaning device 13 removes and collects the toner remaining on the photosensitive drum 7 from which the toner image has been transferred onto the intermediate transfer belt 15, thereby making it possible to record a new electrostatic latent image and a new toner image on the photosensitive drum 7.

It should be noted that the charging device 4, the laser writing unit, the developing device 11, the charging device 2, the first transfer device 12*a*, and the cleaning device 13 are disposed around the photosensitive drum 7 of the visible-image forming unit 50*a* in this order from the upstream of the rotation direction of the photosensitive drum 7.

In the image forming apparatus 100 of the present embodiment, such ion generating devices 1 as will be described below are used as the charging devices 2, 3, and 4.

The following describes an image forming operation of the image forming apparatus 100.

First, the image forming apparatus 100 acquires image data from an external device. Further, a driving unit (not shown) of the image forming apparatus 100 causes the photosensitive drum 7 to rotate at a predetermined peripheral velocity in a direction indicated by an arrow in FIG. 2, and the charging device 4 charges a surface of the photosensitive drum 7 so that the surface of the photosensitive drum 7 has a predetermined potential.

Next, the laser writing unit exposes the surface of the photosensitive drum 7 to light in accordance with the image data thus acquired, and writes an electrostatic latent image onto the surface of the photosensitive drum 7 in accordance with the image data. Then, the developing device 11 supplies toner to the electrostatic latent image formed on the surface of the photosensitive drum 7, thereby forming a toner image by causing the toner to adhere to the electrostatic latent image.

The toner image thus formed on the surface of the photosensitive drum 7 is recharged by the charging device 2. The toner image thus recharged is transferred onto the intermediate transfer belt 15 by the first transfer device 12*a* applying a bias voltage opposite in polarity to the toner image formed on the surface of the photosensitive drum 7 (first transfer).

The visible-image forming units 50*a* to 50*d* take turns in performing this operation, so that four toner images respectively having four colors Y, M, C, and K are superimposed onto one another on the intermediate transfer belt 15.

The toner images thus superimposed onto one another are conveyed to the charging device 3 by the intermediate transfer belt 15, and the toner images thus conveyed are recharged by the charging device 3. Then, the intermediate transfer belt 15 carrying the toner images thus recharged is pressed by the second transfer device 16 against a sheet of recording paper fed from a paper feeding unit (not shown), so that the toner images are transferred onto the sheet of recoding paper (second transfer).

Thereafter, the fixing device 14 fixes the toner images onto the sheet of recording paper, and the sheet of recording paper on which an image has been recorded is ejected onto a paper ejection unit (not shown). The toner remaining on the photosensitive drum 7 after the first transfer is removed and collected by the cleaning device 13, and the toner remaining on the intermediate transfer belt 15 after the second transfer is removed and collected by the cleaning device 17. The foregoing operation makes it possible to perform appropriate printing on a sheet of recording paper.

The following describes arrangements of the ion generating devices 1 used as the three charging devices 2, 3, and 4.

Figure 3:
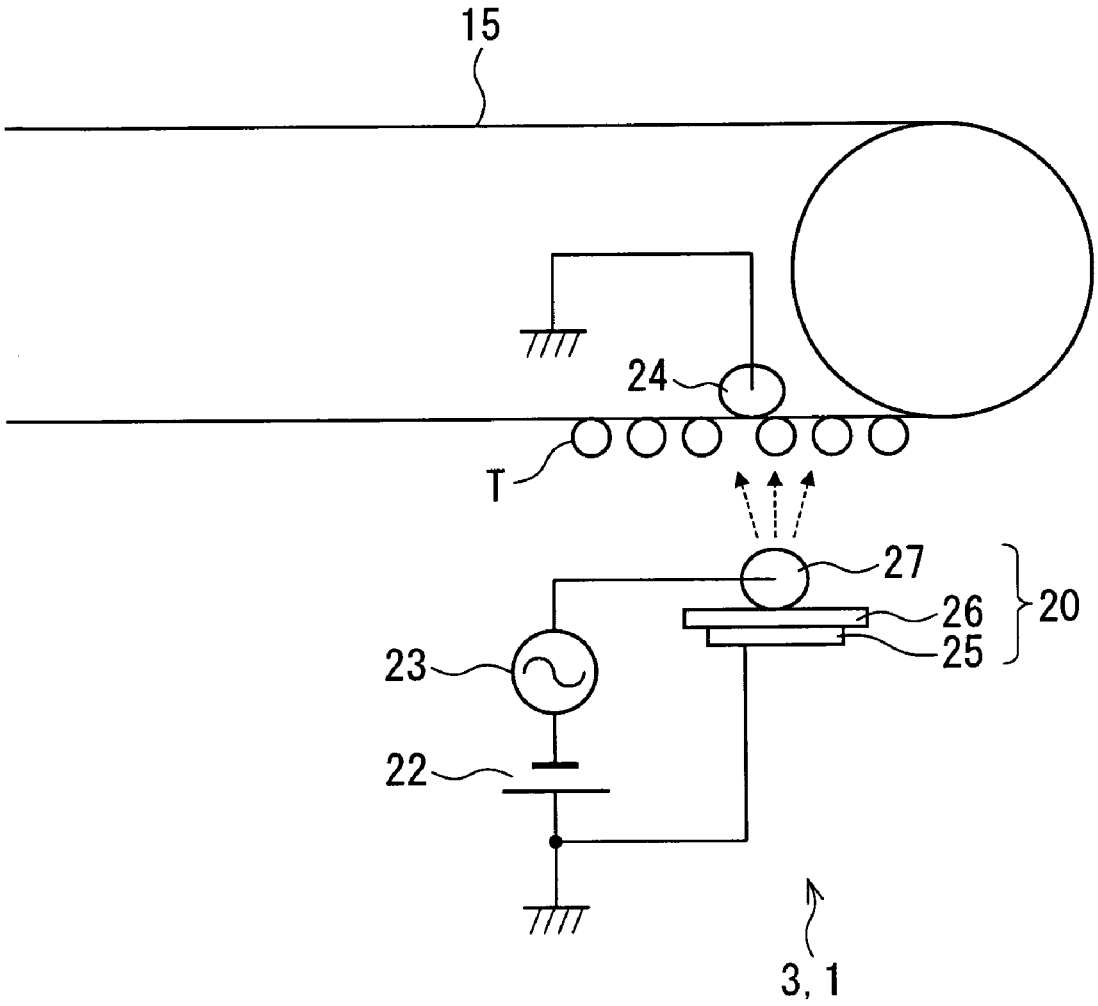
FIG. 3 is an explanatory diagram showing an arrangement of the ion generating device used in the image forming apparatus as the charging device for charging before a second transfer.

FIG. 3 shows the arrangement of the ion generating device 1 disposed as the charging device 3 near the intermediate transfer belt 15.

As shown in FIG. 3, the charging device 3 includes a creeping discharge element 20, an alternating voltage applying section 23, a DC bias voltage applying section 22, and a counter electrode 24.

The creeping discharge element 20 includes a dielectric material 26, an inductive electrode 25 disposed on one surface of the dielectric material 26, and a discharge electrode 27 disposed on the other surface of the dielectric material 26.

The inductive electrode 25 is constituted, for example, by a ribbon electrode layer formed on one surface of the dielectric material 26. Such an electrode layer is processed with use of a photolithographic technique or the like. Moreover, the inductive electrode 25 is formed entirely on the dielectric material 26 except an outer portion of the dielectric material 26 so that discharge occurs only on the side of the discharge electrode 27. The inductive electrode 25 can be made, for example, of tungsten wire, molybdenum, and stainless steel.

The discharge electrode 27 is constituted by a wire electrode member disposed so as to make contact with the other surface of the dielectric material 26. Moreover, although described below in detail, the discharge electrode 27 is only fixed at both ends thereof so as to traverse the dielectric material 26 in a longitudinal direction of the dielectric material 26. The discharge electrode 27 is arranged so as to freely move with respect to the dielectric material 26. Such a discharge electrode 27 can be made, for example, of tungsten, molybdenum, and stainless steel.

Further, it is preferable that the diameter of the discharge electrode 27 fall within a range of not less than 20 μm to not more than 100 μm. When the diameter of the discharge electrode 27 is smaller than 20 μm, the discharge efficiency of the discharge electrode 27 increases, but the mechanical strength of the discharge electrode 27 becomes insufficient. This shortens the life of the discharge electrode 27. On the other hand, when the diameter of the discharge electrode 27 exceeds 100 μm, the discharge efficiency of the discharge electrode 27 decreases, and the discharge electrode 27 requires strength of a member for fixing the discharge electrode 27. This causes the device to be huge.

Moreover, in consideration of the mechanical strength, it is preferable that the lower limit fall within a range of not less than 30 μm. Further, in consideration of the discharge efficiency and the strength of the member for fixing the discharge electrode 27, it is preferable that the upper limit fall within a range of not more than 70 μm.

It is desirable that each of the inductive electrode 25 and the discharge electrode 27 be plated with copper, gold, nickel, or the like. Plating makes it possible to extend the life of the electrode and increase the strength of the electrode. Among them, gold plating is most preferable.

The dielectric material 26 interposed between the inductive electrode 25 and the discharge electrode 27 is a long plate member, and can be made of mica material, ceramic, a resin film, or the like. Among them, mica paper made by joining pieces of mica on top of each other with resin is preferable in terms of price, insulating properties, and processability, Usable examples of the mica paper include MICATITE MCT-BS manufactured by Okabe Mica Co., Ltd. The size of each mica flake of MICATITE MCT-BS is such that the thickness ranges from 1 μm to 10 μm and the mean diameter ranges from 100 μm to 200 μm.

In consideration of the dielectric breakdown voltage between the discharge electrode 27 and the inductive electrode 25, it is necessary that the dielectric material 26 made of mica paper have a thickness of at least 1 mm.

Usable examples of the mica paper include MICATITE MCT-BS manufactured by Okabe Mica Co., Ltd. The size of each mica flake of MICATITE MCT-BS is such that the thickness ranges from 1 μm to 10 μm and the mean diameter ranges from 100 μm to 200 μm.

In consideration of the dielectric breakdown voltage between the discharge electrode 27 and the inductive electrode 25, it is necessary that the dielectric material 26 made of mica paper have a thickness of at least 1 mm.

The counter electrode 24 is disposed so as to face the discharge electrode 27. The counter electrode 24 is grounded. Such a counter electrode 24 is disposed so as to make it easy for the discharge electrode 27 to discharge. The counter electrode 24 is not an absolute necessity; that is, the counter electrode 24 can be omitted.

The DC bias voltage applying section 22 applies a DC bias voltage to the discharge electrode 27. The alternating voltage applying section 23 applies an alternating voltage between the inductive electrode 25 and the discharge electrode 27.

In the ion generating device 1 thus arranged, the discharge electrode 27 discharges when an alternating voltage having a frequency of several hundred Hz to several hundred kHz and a pulse height of 1 kV to 5 kV is applied between the discharge electrode 27 and the inductive electrode 25.

When the discharge electrode 27 discharges, air between the electrodes is ionized in a discharge area, so that positive and negative corona ions are generated near the ionized air. The corona ions thus generated are taken out by applying a DC bias voltage to the discharge electrode 27.

In cases where the DC bias voltage thus applied is a negative voltage, only negative ions are taken out from the ion generating device 1. On the other hand, in cases where the DC bias voltage thus applied is a positive voltage, only positive ions are taken out from the ion generating device 1.

The following fully describes the discharge electrode 27 in terms of being arranged so as to freely move with respect to the dielectric material 26.

Figure 1:
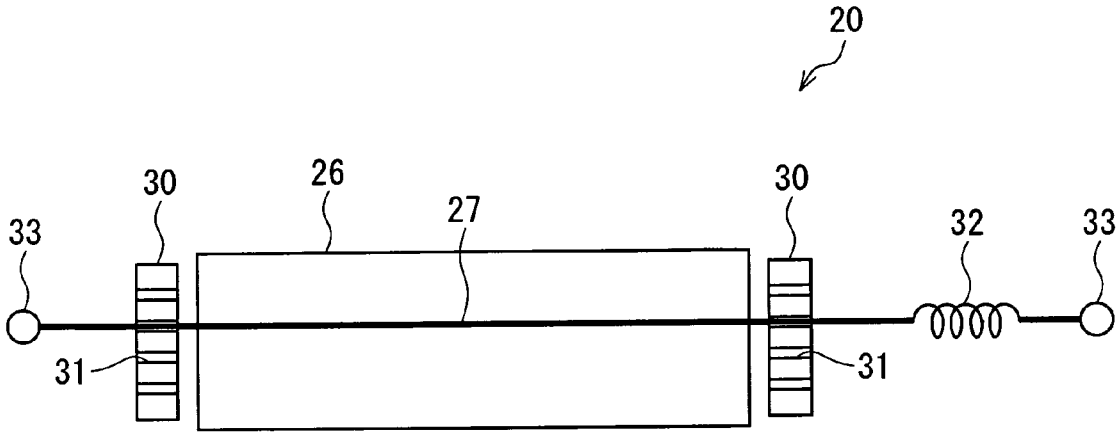
FIG. 1, showing Embodiment 1 of the present invention, is an explanatory diagram showing a creeping discharge element of an ion generating device as seen from a discharge electrode.
Figure 4:
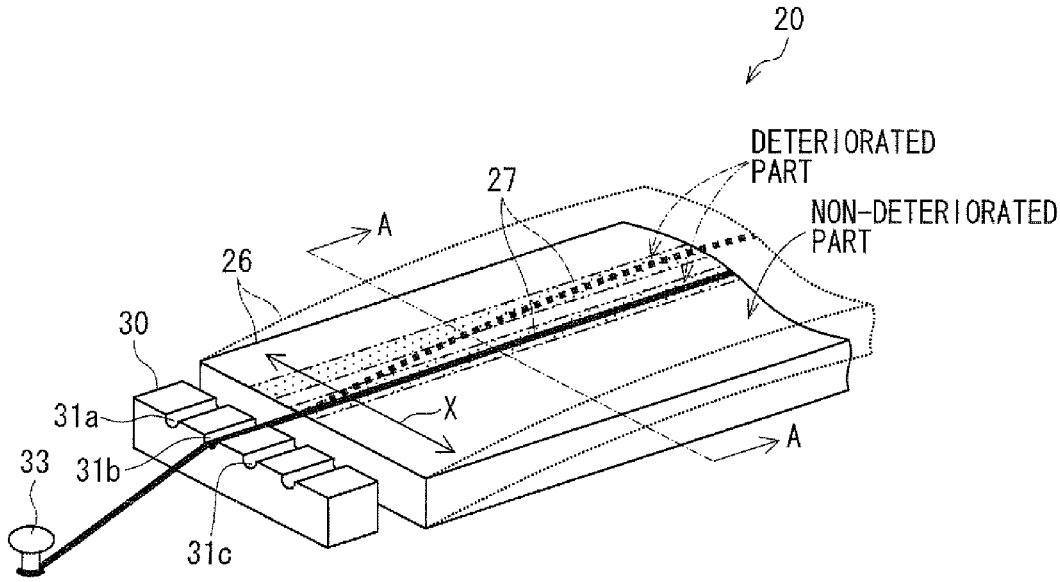
FIG. 4 is a perspective view showing an arrangement of the creeping discharge element of the ion generating device as seen from an end of the creeping discharge element in a longitudinal direction of the creeping discharge element.

FIG. 1 is a plan view showing the creeping discharge element 20 of the ion generating device 1 as seen from the side on which the discharge electrode 27 is disposed. Further, FIG. 4 is a perspective view showing the creeping discharge element 20 as seen from an end of the creeping discharge element 20 in a longitudinal direction of the dielectric material 26.

As shown in FIG. 1, one end of the discharge electrode 27 is connected directly to a retaining member (supporting member) 33, and the other end of the discharge electrode 27 is connected to a retaining member (supporting member) via an elastic member 32. The elastic member 32 causes the discharge element 27 to be stretchable in the axial direction of the discharge element 27.

Moreover, the ends of the discharge electrode 27 are fixed by the retaining members 33 so as be lower than a surface of the dielectric material 26 in contact with the discharge electrode 27. Since the ends of the discharge electrode 27 are thus fixed by the retaining members 33 so as be lower than the surface of the dielectric material 26 in contact with the discharge electrode 27, the stretchable discharge electrode 27 makes close contact with the dielectric material 26 entirely in the longitudinal direction of the dielectric material 26.

As described above, the dielectric material 26 is a very thin plate member. Therefore, the dielectric material 26 may be deformed. If the dielectric material 26 is warped in such a manner that the surface of the dielectric material 26 in contact with the discharge electrode 27 is concaved across a central part of the longitudinal direction, the dielectric material 26 and the discharge electrode 27 are prevented from making contact with each other entirely in the longitudinal direction of the dielectric material 26.

In view of this, it is preferable that the dielectric material 26 be warped from the beginning, rather than being shaped into a flat plate, in such a manner that the surface of the dielectric material 26 in contact with the discharge electrode 27 is concaved across the central part of the longitudinal direction. By thus warping the dielectric material 26 in advance, the discharge electrode 27 can be surely brought into close contact with the dielectric material 26.

Disposed between the ends of the dielectric material 26 in the longitudinal direction and the retaining members 33 are positioning members 30, respectively. The positioning members 30 serve to determine the position of the discharge electrode 27 with respect to the dielectric material 26. Each of the positioning members 30 is provided with a plurality of (four in FIG. 1) groove-like hook sections (holding sections) 31 on which the discharge electrode 27 is hung and held. The plurality of hook sections 31 are provided in parallel with one another along a direction, indicated by an arrow X, which is orthogonal to a longitudinal direction of the surface of the dielectric material 26 in contact with the discharge electrode 27.

In such an arrangement, the position of the discharge electrode 27 with respect to the dielectric material 26 is changed in the direction of the arrow X by switching the discharge electrode 27 from one pair of hook sections 31 to another, so that those portions of the dielectric material 26 which make contact with the discharge electrode 27 can be switched. The hook sections 31 to be engaged can be easily switched with use of the stretchability attributed to the elastic member 32.

In FIG. 4, that portion of the dielectric material 26 which makes contact with the discharge electrode 27 while the discharge electrode 27 is being held by the hook sections 31*a* and that portion of the dielectric material 26 which makes contact with the discharge electrode 27 when the discharge electrode 27 is being held by the hook sections 31*b* are already in a state of deterioration. In such a state, the discharge electrode 27 only needs to be switched to the adjoining hook sections 31*c* so as to make contact with a non-deteriorated part of the dielectric material 26.

Figure 5:
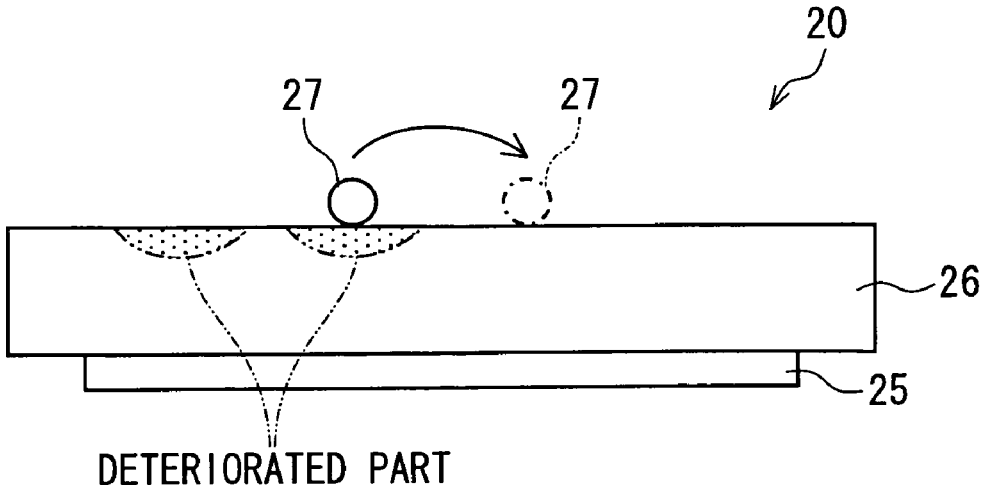
FIG. 5 is an explanatory diagram showing how the position of the discharge electrode with respect to a dielectric material is changed in the ion generating device by switching the discharge electrode from one pair of hook sections to another.

FIG. 5 shows how the discharge electrode 27 is switched from one pair of hook sections 31*b* to an adjoining pair of hook sections 31*c*. It should be noted that FIG. 5 is a cross-sectional view taken along the line A-A of FIG. 4.

By simple arithmetic, since the arrangement of FIG. 4 is provided with four pairs of hook sections 31, the arrangement has life approximately four times longer than the life of a conventional ion generating device.

The following explains a result obtained by examining a deterioration characteristic of the dielectric material 26 and a relationship between deterioration and image quality in order to determine a timing at which the position of the discharge electrode 27 is switched.

MICATITE MCT-BS manufactured by Okabe Mica Co., Ltd. was used as the dielectric material 26, and a tungsten wire having a diameter of 60 μm was used as the discharge electrode 27. A DC bias voltage of −1.5 kV was applied to the discharge electrode 27, and an alternating voltage having a pulse height of 3.0 kV and a frequency of 500 Hz was applied between the inductive electrode 25 and the discharge electrode 27.

Then, the amount of current flowing through the intermediate transfer belt 15 disposed between the discharge electrode 27 and the counter electrode 24 was measured every time five hours after the start of discharge by inserting a DC voltmeter between the counter electrode 24 and the ground. Similarly, an image was formed every five hours by charging toner on the intermediate transfer belt 15 before a transfer. The quality of the image was visually inspected.

Figure 6:
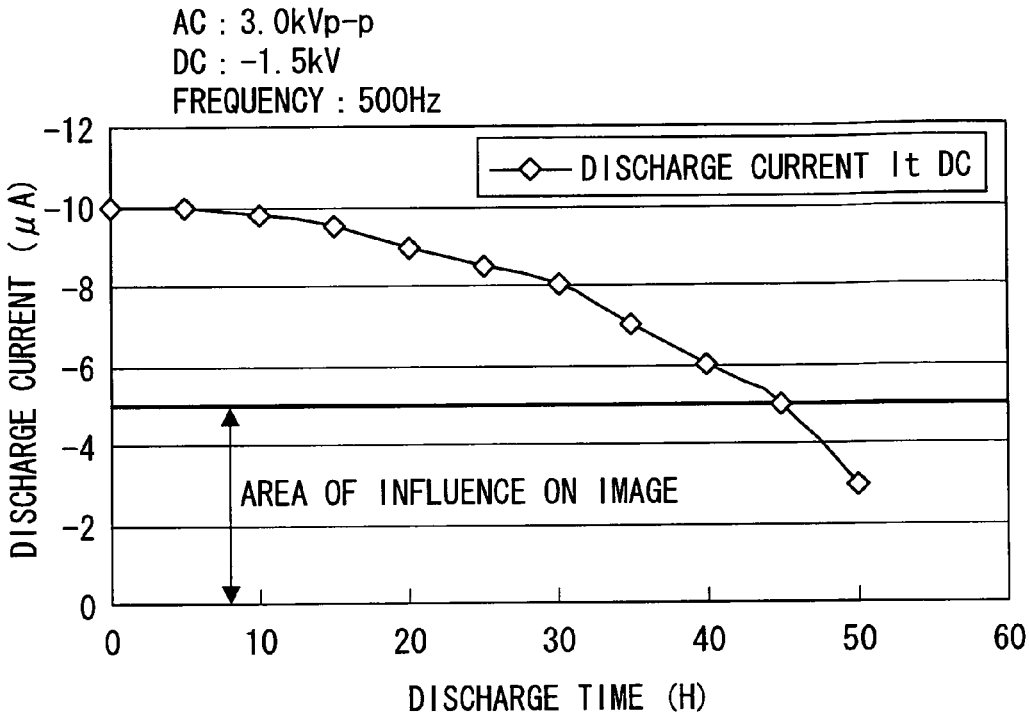
FIG. 6 is a graph showing a result obtained by using the ion generating device to examine a relationship of discharge time to discharge current and image quality.

FIG. 6 shows a result obtained by examining a relationship of discharge time to discharge current and image quality. As shown in FIG. 6, as the discharge time becomes longer, the discharge current gradually decreases while drawing a parabola. This shows that the dielectric material 26 deteriorates as the discharge time becomes longer.

Even as the discharge current (μA) decreased, the image quality had no trouble in cases where the discharge current exceeded −5 μA (in absolute value). However, when the discharge time reached 45 hours and the discharge current became not more than −5 μA (in absolute value), the image quality was influenced (area of influence on an image). Specifically, the density of a solid image became low, and the solid image came to have brush marks. This is because a decrease in amount of discharge from the discharge electrode 27 prevented the toner on the intermediate transfer belt 15 from being sufficiently charged and thereby caused a decrease in transfer efficiency.

In order to transfer the toner from the intermediate transfer belt 15 onto a sheet or the like with high transfer efficiency, it is necessary to charge the toner so that the toner has a required amount of charge. Pretransfer charging supplements the amount of charge. In order to transfer the toner from the intermediate transfer belt 15 onto a sheet or the like with high transfer efficiency, it is necessary to charge the toner so that the toner has an amount of charge of not less than −20 μq (in absolute value).

Therefore, the ion generating device 1 disposed as the charging device 3 requires a discharge current of more than −5 μA (in absolute value). At a point of time where the discharge current becomes not more than −5 μA (in absolute value), a portion of the dielectric material 26 in contact with the discharge electrode 27 can be judged to have deteriorated. However, in reality, it is only necessary to move the discharge electrode 27 after a discharge time of approximately 40 hours in view of the margin.

As shown above, the judgment of deterioration of a contact portion of the dielectric material 26 varies depending on the amount of discharge required of the ion generating device 1. Further, the amount of discharge required of the ion generating device 1 is determined by how the ion generating device 1 is used. Therefore, the dielectric material 26 can be used for a longer period of time by changing the criterion for judgment of deterioration of a contact portion in accordance with how the ion generating device 1 is used.

The following explains a result obtained by examining, in order to determine the distance by which the discharge electrode 27 is moved, the extent of deterioration around a portion of the dielectric material 26 in contact with the discharge electrode 27.

Also in this case, MICATITE MCT-BS manufactured by Okabe Mica Co., Ltd. was used as the dielectric material 26, and a tungsten wire having a diameter of 60 μm was used as the discharge electrode 27. A DC bias voltage of −1.5 kV was applied to the discharge electrode 27, and an alternating voltage having a pulse height of 3.0 kV was applied between the inductive electrode 25 and the discharge electrode 27.

Then, an area of the dielectric material where color has been changed was visually judged as a deteriorated area.

Figure 7:
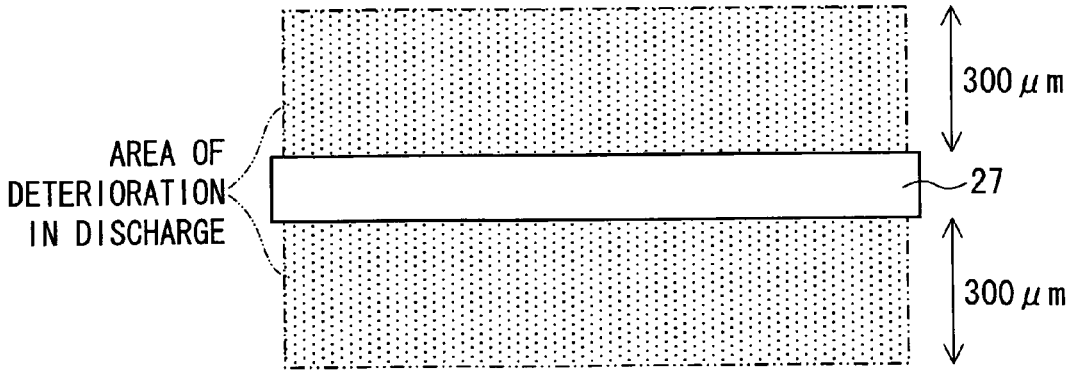
FIG. 7 is an explanatory diagram showing a result obtained by using the ion generating device to examine the extent of deterioration of the dielectric material with respect to the discharge electrode.

FIG. 7 shows a result obtained by examining, by brining the discharge electrode 27 into close contact with the dielectric material 26, the extent of deterioration around the portion of the dielectric material 26 in contact with the discharge electrode 27. As shown in FIG. 7, areas extending for approximately 300 μm on both sides of the axial direction of the discharge electrode 27 were found to have deteriorated. The same result was obtained even when a tungsten wire having a diameter of 30 μm was used as the discharge electrode 27.

The extent of deterioration was examined while changing the value of the DC bias voltage and the alternating voltage. As a result, it was confirmed that although there was a difference in time taken for deteriorated areas to emerge on both sides of the axial direction of the discharge electrode 27, there was no change in size of the deteriorated areas.

Furthermore, in addition to the wire discharge electrode 27, a conventional creeping discharge element in which a ribbon discharge electrode is provided on one surface of a dielectric material made of MICATITE MCT-BS was examined for the purpose of seeing how a deteriorated area emerges. Also in this case, substantially the same result was obtained.

In view of this, the present embodiment sets a margin of 300 μm in consideration of the thickness of the discharge electrode 27, and forms hook sections 31 so that the discharge electrode 27 can be moved by increments of 1 mm.

The following explains a result obtained by examining a discharging characteristic in the ion generating device 1 including the creeping discharge element 20 using the wire discharge electrode 27.

As in the previous test, MICATITE MCT-BS manufactured by Okabe Mica Co., Ltd. was used as the dielectric material 26, and a tungsten wire having a diameter of 60 μm (Example 1) and a tungsten wire having a diameter of 30 μm (Example 2) were each used as the discharge electrode 27. A DC bias voltage of −1.5 kV was applied to the discharge electrode 27, and an alternating voltage having a pulse height of 3.0 kV was applied between the inductive electrode 25 and the discharge electrode 27.

Then, the amount of current flowing through a charged object disposed between the discharge electrode 27 and the counter electrode 24 was measured while changing the frequency of the alternating voltage applied between the inductive electrode 25 and the discharge electrode 27 and by inserting a DC voltmeter between the counter electrode 24 and the ground.

As Comparative Example, a ribbon electrode made of tungsten and having a width of 0.3 mm was formed as a discharge electrode on a surface of a similar dielectric material 26 made of MICATITE MCT-BS, and the discharge performance was examined under the same conditions.

Figure 8:
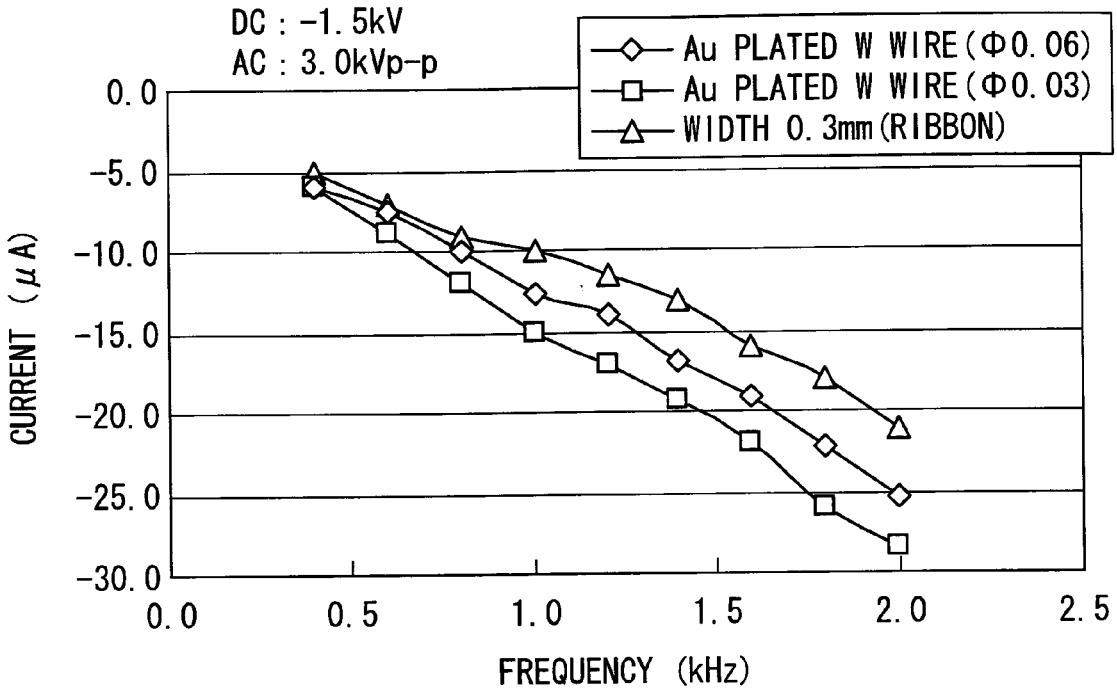
FIG. 8, showing an example for use in comparison with an embodiment of the present invention, is a graph showing a result obtained by examining a discharging characteristic.

FIG. 8 shows a result obtained by examining the discharge performance. As shown in FIG. 8, in each of (i) the creeping discharge element 20 of Example 1 whose discharge electrode 27 is made of a tungsten wire having a diameter of 60 μm, (ii) the creeping discharge element 20 of Example 2 whose discharge electrode 27 is made of a tungsten wire having a diameter of 30 μm, and (iii) the creeping discharge element of Comparative Example whose discharge electrode is made of a tungsten ribbon having a width of 0.3 mm, the amount of current increases as the frequency of the alternating voltage applied between the inductive electrode 25 and the discharge electrode 27 (ribbon discharge electrode in the case of Comparative Example) increases.

Example 1, Example 2, and Comparative Example show that as compared with a ribbon discharge electrode, a wire discharge electrode can better increase the amount of current flowing through a charged object, with the alternating voltage at the same frequency.

The reason for this is as follows. In the case of a ribbon discharge electrode, creeping discharge is performed mainly in an edge portion. On the other hand, in the case of an extra fine discharge electrode 27 having a diameter of 60 μm or 30 μm, creeping discharge occurs entirely on an outer circumferential surface.

This shows that as compared with a ribbon discharge electrode, a wire discharge electrode can better increase the amount of discharge and thereby reduce the value of an alternating voltage to be applied between the discharge electrode 27 and the inductive electrode 25.

Furthermore, Examples 1 and 2 show that as a wire discharge electrode has a larger diameter, the wire discharge electrode can better increase the amount of current flowing through a charged object, with the alternating voltage at the same frequency.

This shows that as the diameter of a wire is made smaller, i.e., as the curvature is made smaller, the amount of discharge can be made larger, so that the value of an alternating voltage to be applied between the discharge electrode 27 and the inductive electrode 25 can be reduced.

As described above, in the image forming apparatus 100 of the present embodiment, each of the ion generating devices 1 provided as the charging devices 2, 3, and 4 is arranged such that the discharge electrode 27 is movable with respect to the dielectric material 26 and that the relative positions of the discharge electrode 27 and the dielectric material 26 can be changed.

With this, even if the accumulated amount of discharge time becomes so large that a defect in discharge occurs due to deterioration caused in a portion of the dielectric material 26 in contact with the discharge electrode 27, the position of the discharge electrode 27 with respect to the dielectric material 26 is changed, so that the portion of the dielectric material in contact with the discharge electrode 27 is switched to a new area free of deterioration. This makes it possible to continuously use the creeping discharge element 20 and the ion generating device 1 without replacing them.

This makes it possible to efficiently use a dielectric material that has conventionally been wastefully disposed with an undeteriorated area remaining thereon. This makes it possible to extend the life of a creeping discharge element or an ion generating device while using a dielectric material of the same size. Moreover, this makes it possible to reduce the total cost including maintenance cost for replacing the creeping discharge element 20 and the ion generating device 1.

The present embodiment exemplifies, as the discharge electrode 27 provided so as to be movable with respect to the dielectric material 26, an arrangement constituted by a wire electrode member. However, the discharge electrode 27 does not need to be fixed onto the dielectric material 26, and the dielectric material 26 and the discharge electrode 27 only need to be movable with respect to each other. As for the shape of a dielectric electrode, the dielectric electrode may be a wide dielectric electrode patterned into a ribbon or the like as conventional.

However, in cases where a discharge electrode that moves with respect to the dielectric material 26 is shaped into a wire, a deteriorated area of the dielectric material 26 that extends from below the discharge electrode 27 to both sides of the discharge electrode 27 can be made smaller as compared with a conventional wide discharge electrode. Therefore, in the case of use of a dielectric material having the same amount of space, the number of times the position of a discharge electrode is switched can be made larger. This brings about an effect of extending the life of a creeping discharge element or an ion generating device.

Further, the present embodiment assumes an arrangement in which the dielectric material 26 is fixed and the discharge electrode 27 is moved with respect to the dielectric material 26. However, such an arrangement is possible that the discharge electrode 27 is fixed and the dielectric material 26 is moved with respect to the discharge electrode 27.

Furthermore, although the ion generating device 1 has the positioning members 30 disposed on both sides of the longitudinal direction of the dielectric material 26, the position of the discharge electrode 27 with respect to the dielectric material 26 can be switched by disposing a positioning member 30 on at least one of the sides.

However, in an arrangement in which a positioning member 30 is disposed only on one of the sides, the discharge electrode 27 does not move in parallel, but moves so as to rotate on the retaining member 33 provided with no positioning member 30. Therefore, in an arrangement in which a positioning member 30 is disposed on either of the sides, it is preferable to dispose a positioning member 30 on a side opposite to a side on which the provision of an elastic member 32 has increased the distance from the dielectric material 26 to the retaining member 33.

Further, although the image forming apparatus 100 of the present embodiment is arranged so as to include ion generating devices 1 of the present invention as the charging devices 2 to 4, the image forming apparatus 100 of the present embodiment can be of course arranged, for example, such that the charging device 4 is a scorotron corona charging device or a roller-type contact charging device. It is only necessary that at least one of the charging devices 2 to 4 be an ion generating device 1.

Furthermore, such ion generating device 1 as described above can be used as an electricity-removing device or a transfer device of an image forming apparatus.

Further, it is preferable that the ion generating device 1 be disposed such that the discharge electrode 27 is located below the dielectric material 26 in a vertical direction. This makes it possible to prevent the surface of the dielectric material 26 in contact with the discharge electrode 27 from being greatly contaminated by toner and dust.

As described above, the ion generating device 1 makes effective use of the whole area of the dielectric material 26 by switching the relative positions of the discharge electrode 27 and the dielectric material 26. In such an arrangement, it is undesirable that the surface of the dielectric material 26 be contaminated by toner and dust. Such disposition of the ion generating device 1 makes it possible to keep the surface of the dielectric material 26 clean.

In particular, since ions and ozone are heavier than air, ions and ozone are likely to flow downward. Therefore, such an arrangement makes it possible to cause generated ions to efficiently reach a charged object and the like.

Further, as described above, in the image forming apparatus 100 of the present embodiment, each of the ion generating devices provided as the charging devices 2 to 4 is arranged such that the discharge electrode 27 is a wire electrode member, that the discharge electrode 27 is not formed directly on a surface of the dielectric material 26, and that the discharge electrode 27 is attached so as to be pressed against the dielectric material 26.

Therefore, the arrangement is simpler than a conventional creeping discharge element and ion generating device in which a discharge electrode has been formed directly on a surface of the dielectric material 26 with use of a photolithographic technique.

Furthermore, the discharge electrode 27 is in the shape of a wire electrode member. Therefore as compared with a ribbon discharge electrode, the discharge electrode 27 can better increase the amount of discharge and thereby reduce the alternating voltage to be applied between the discharge electrode 27 and the inductive electrode 25. This makes it possible to save electric power and to inhibit the dielectric material 26 from deteriorating.

Further, the discharge electrode 27 is not formed directly on the dielectric material 26. This makes it possible to relatively change the positional relationship with the dielectric material 26 as described above. This makes it possible to extend the life of the ion generating device 1 or the creeping discharge element 20 with efficient use of the dielectric material 26, for example, by sequentially switching contact portions of the dielectric material 26.

Embodiment 2

Figure 9:
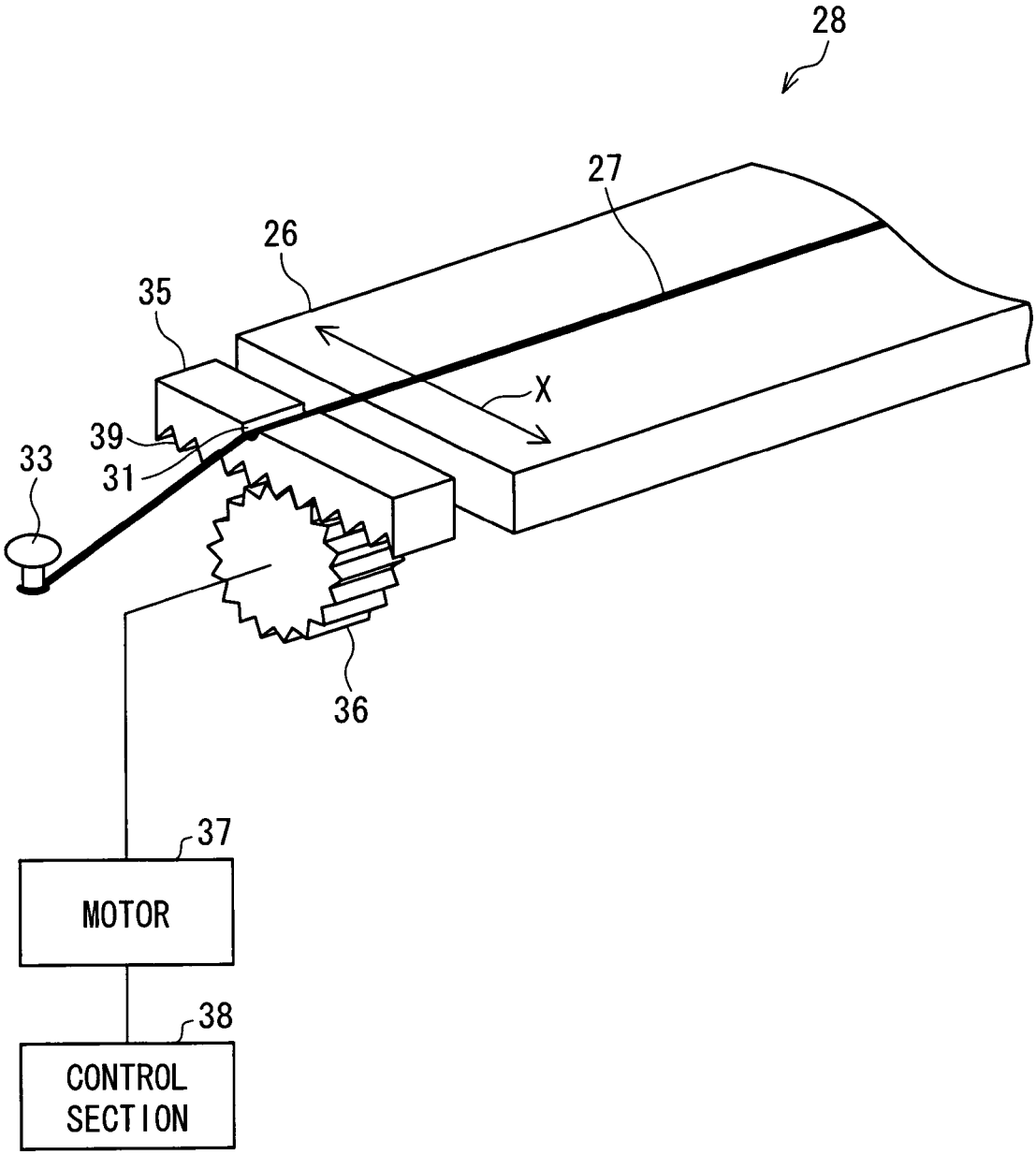
FIG. 9, showing Embodiment 2 of the present invention, is an explanatory diagram showing an arrangement of an ion generating device.

Another embodiment of the present invention will be described below with reference to FIGS. 9 and 10. For convenience of explanation, members having the same functions as those used in Embodiment 1 will be given the same reference numerals and will not be described below.

An image forming apparatus of the present embodiment differs from the image forming apparatus 100 of Embodiment 1 in terms of ion generating devices that are used as a charging device 2 for charging before a first transfer, a charging device 3 for charging before a second transfer, and a latent image charging device 4. In each ion generating device 28 provided in the image forming apparatus of the present embodiment, the position of a discharge electrode 27 with respect to a dielectric material 26 can be automatically switched.

The following describes only parts different from those of the ion generating device 1. As shown in FIG. 9, the ion generating device 28 has a positioning member 35 provided with a single hook section 31. Moreover, the positioning member 35 has a rack gear 39 formed on a lower surface thereof. Disposed below the positioning member 35 is a pinion gear 36 that engages with the rack gear 39.

In such an arrangement, the rotation of the pinion gear 36 causes the positioning member 35 to slide in a direction indicated by an arrow X, so that the position of the discharge electrode 27 held by the hook section 31 is changed in the same direction with respect to the dielectric material 26. The moving direction indicated by the arrow X is a direction orthogonal to a longitudinal direction of a surface of the dielectric material 26 in contact with the discharge electrode 27.

Furthermore, in the present embodiment, the pinion gear 36 is designed to receive driving force of a motor 37 that is so controlled by a control section 38 as to be driven, so that the position of the discharge electrode 27 is switched at an appropriate timing in consideration of deterioration of the dielectric material 26.

Figure 10:
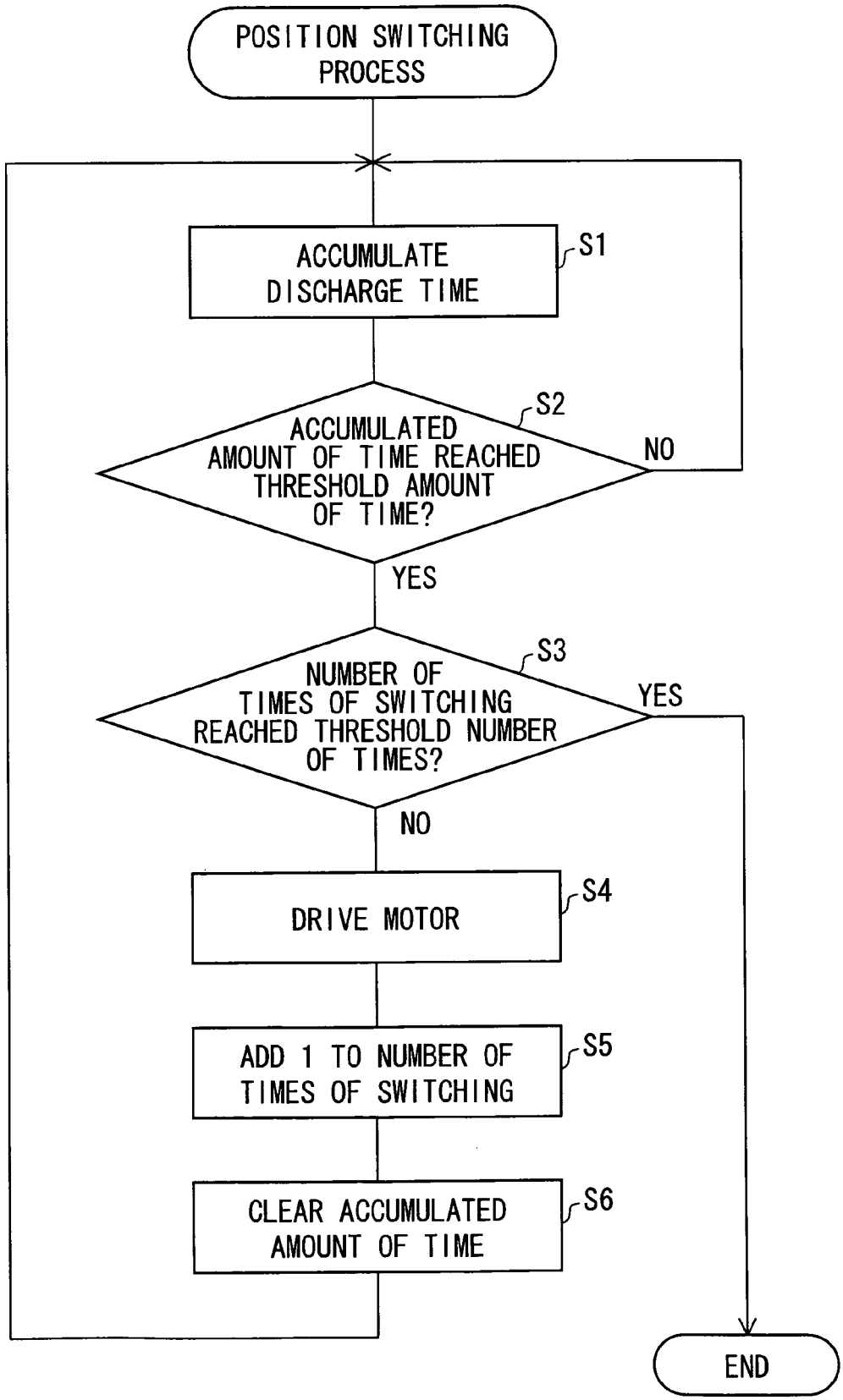
FIG. 10 is a flow chart showing the steps of a position switching process of automatically switching the position of a discharge electrode in the ion generating device.

FIG. 10 shows the steps of a position switching process by which the control section 38 automatically switches the position of the discharge electrode 27.

First, the control section 38 accumulates discharge time taken in the ion generating device 28 (S1). Next, the control section 38 determines whether or not the accumulated amount of time has reached a threshold amount of time (S2).

The "threshold amount of time" here indicates the application limit of the dielectric material 26 as set in consideration of such an area of influence on an image as shown in FIG. 6. In cases where the control section 38 determines in S2 that the accumulated amount of time has not reached the threshold amount of time, the control section 38 returns to S1 and repeats the process of accumulating discharge time.

On the other hand, in cases where the control section 38 determines in S2 that the accumulated amount of time has reached the threshold amount of time, the control section 38 determines whether or not the number of times of position switching has reached a threshold number of times (S3). The "threshold number of times" here depends on the size of the dielectric material 26 and corresponds to the number of positions that the discharge electrode 27 can take with respect to the dielectric material 26. If the dielectric material 26 has the same size as in the ion generating device 1 provided with four pairs of hook sections 31, the number of times of switching is 4.

In cases where the control section 38 determines in S3 that the number of times of position switching has not reached the threshold number of times, the control section 38 drives the motor 37 for a predetermined period of time (S4). The motor 37 thus driven causes the positioning member 35 to move a predetermined distance, so that the position of the discharge electrode 27 is switched (S4). After that, a counter that counts the number of times of switching counts up one (S5), and a counter that counts the accumulated amount of time is cleared (S6). Then, the control section 38 returns to S1.

On the other hand, in cases where the control section 38 determines in S3 that the number of times of position switching has reached the threshold number of times, the control section 38 terminates the process. In so doing, the control section 38 may cause a display section (not shown) of the image forming apparatus, for example, to display a message that recommends replacing the ion generating device 28 or replacing a creeping discharge element of the ion generating device 28.

As described above, in the ion generating device 28 provided in the image forming apparatus of the present embodiment, the position of the discharge electrode 27 with respect to the dielectric material 26 can be automatically switched. This makes it possible to automatically switch the position of the discharge electrode 27 with respect to the dielectric material 26. This enables the device to have excellent maintainability.

Embodiment 3

Figure 11:
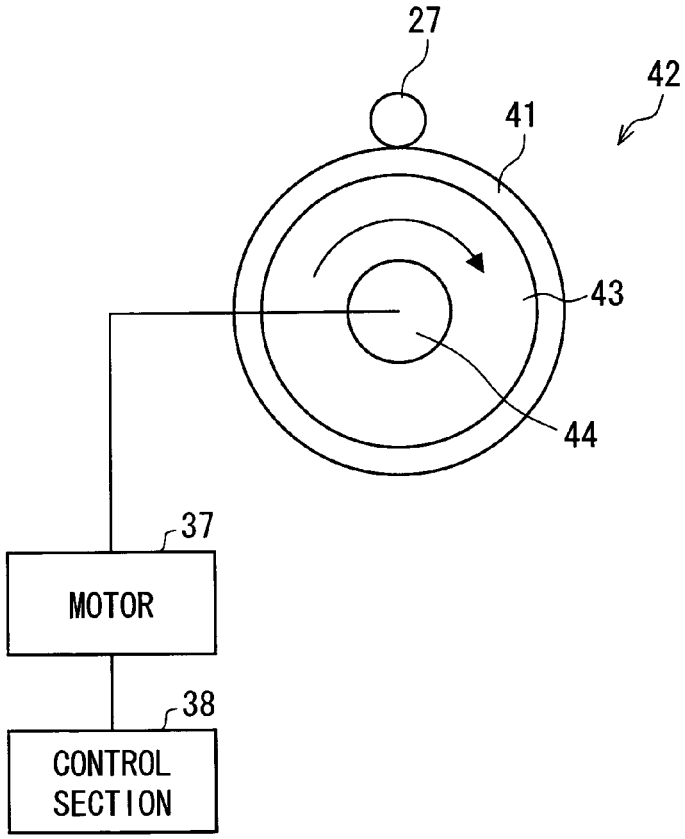
FIG. 11, showing Embodiment 3 of the present invention, is an explanatory diagram showing an arrangement of an ion generating device.

Another embodiment of the present invention will be described below with reference to FIGS. 11 through 13. For convenience of explanation, members having the same functions as those used in Embodiments 1 and 2 will be given the same reference numerals and will not be described below.

An image forming apparatus of the present embodiment differs from the image forming apparatus 100 of Embodiment 1 in terms of ion generating devices that are used as a charging device 2 for charging before a first transfer, a charging device 3 for charging before a second transfer, and a latent image charging device 4. In each ion generating device 42 provided in the image forming apparatus of the present embodiment, the position of a discharge electrode 27 with respect to a dielectric material 26 can be automatically switched as in the ion generating device 28 of Embodiment 2.

The following describes only parts different from those of the ion generating device 28. As shown in FIG. 11, the ion generating device 42 has a cylindrical dielectric material 41 and a discharge electrode 27 disposed so as to make close contact with an outer circumferential surface of the dielectric material 41. The cylindrical dielectric material 41 has an inductive electrode 43 provided on an inner circumferential surface thereof. The dielectric material 41 and the inductive electrode 43 are arranged so as to be freely rotated by a rotary shaft 44.

In such an arrangement, the rotation of the rotary shaft 44 causes the dielectric material 41 to rotate, so that the position of the dielectric material 41 with respect to the discharge electrode 27 is changed. Also in the present embodiment, the rotary shaft 44 is designed to receive driving force of a motor 37 that is so controlled by a control section 38 as to be driven, so that the position of the dielectric material 41 with respect to the discharge electrode 27 is switched at an appropriate timing in consideration of deterioration of the dielectric material 41.

In such an arrangement, even a small degree of rotation of the dielectric material 41 allows the discharge electrode 27 to face a new area free of deterioration, so that a large number of times of switching can be ensured. Therefore, even when a resin film that is inexpensive but more prone to dielectric breakdown than mica material and ceramic is used as the dielectric material 41, the life of the ion generating device 42 or a creeping discharge element can be extended.

Figure 12:
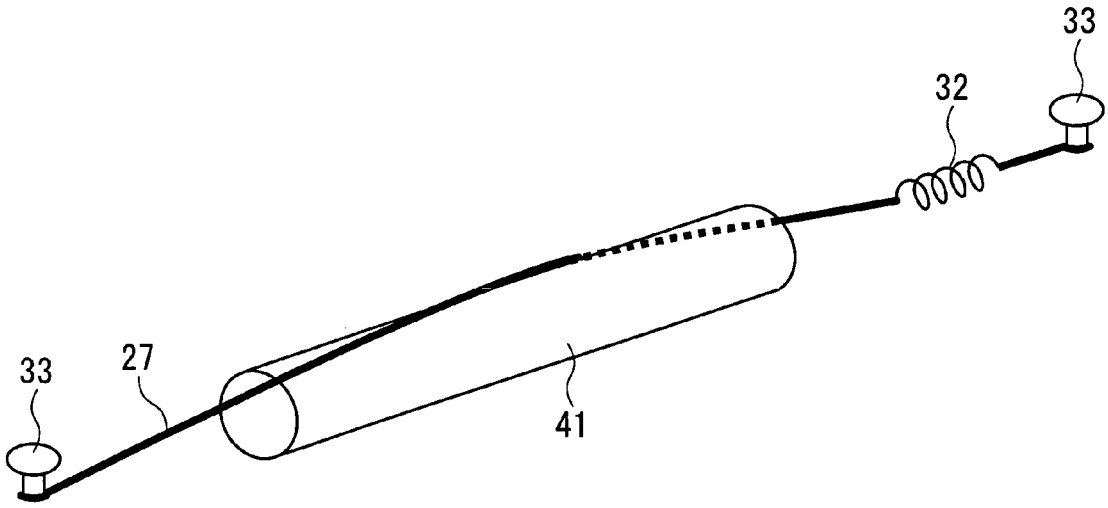
FIG. 12 is an explanatory diagram showing a preferred example of how a discharge electrode is disposed in the ion generating device.

Further, in such an arrangement that the discharge electrode 27 is disposed on the outer circumferential surface of the cylindrical dielectric material 41, it is preferable that, as shown in FIG. 12, the discharge electrode 27 be disposed so as to be skewed with respect to the axis of the dielectric material 41. By thus disposing the discharge electrode 27 so that the discharge electrode 27 is skewed, the discharge electrode 27 is allowed to make close contact with the outer circumferential surface of the cylindrical dielectric material 41 entirely in the axial direction.

Figure 13:
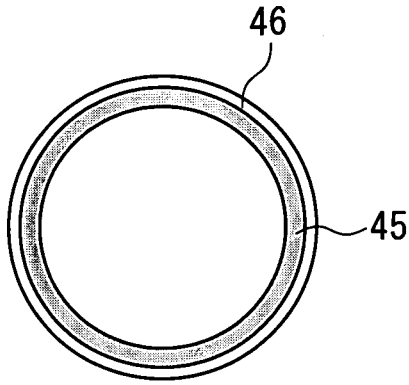
FIG. 13(*a*) through 13(*c*) are each an explanatory diagram showing a specific arrangement of a rotating roller having a discharge electrode provided on the inner circumference of a dielectric material.
Figure 13:
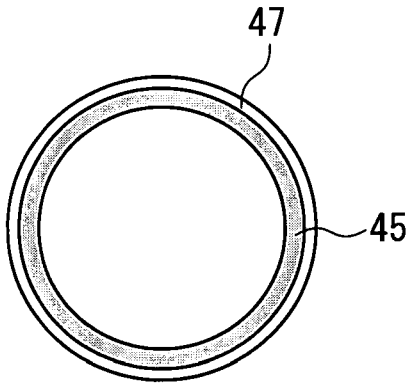
Figure 13:
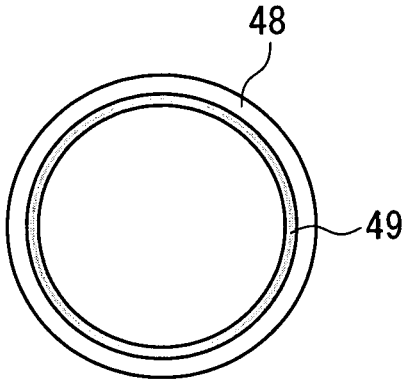

The cylindrical dielectric material 41 and the inductive electrode 43 formed on the inner circumferential surface thereof can be arranged, as shown in FIG. 13(*a*) for example, by covering, with an insulating resin tube 46, a metal cylinder 45 made of aluminum, stainless steel, or the like.

Alternatively, the dielectric material 41 and the inductive electrode 43 can be arranged, as shown in FIG. 13(*b*), by coating, with ceramic 47, a metal cylinder 45 made of aluminum, stainless steel, or the like. Alternatively, the dielectric material 41 and the inductive electrode 43 can be arranged, as shown in FIG. 13(*c*), by coating an inner circumferential surface of a glass tube 48 with metal 49 such as gold.

Embodiment 4

Another embodiment of the present invention will be described below with reference to FIGS. 14 and 15. For convenience of explanation, members having the same functions as those used in Embodiments 1 to 3 will be given the same reference numerals and will not be described below.

Figure 14:
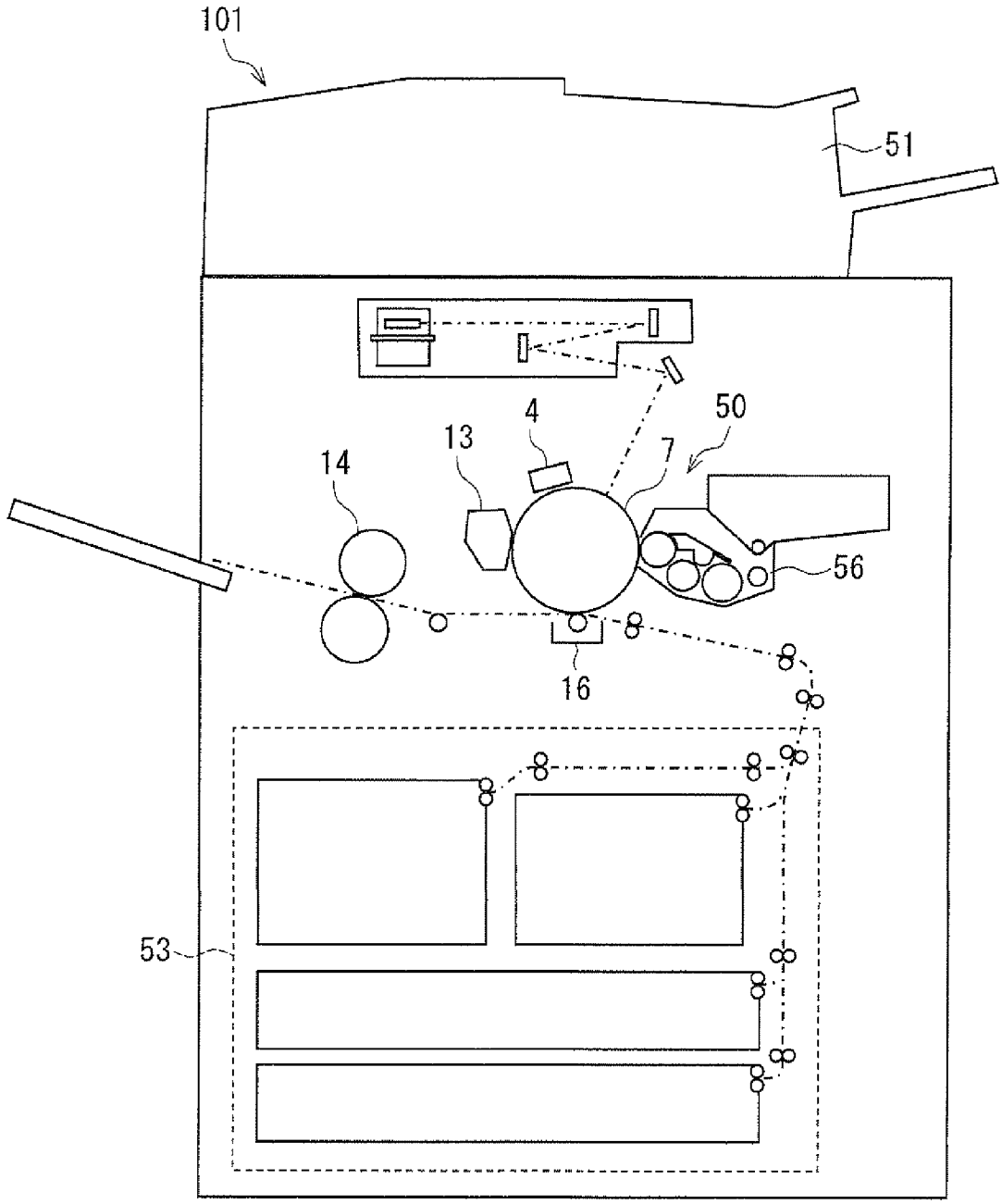
FIG. 14, showing Embodiment 4 of the present invention, is an explanatory diagram showing an arrangement of a main part of an image forming apparatus in which an ion generating device is used as a toner precharging device that is to be disposed in a developing device.

As shown in FIG. 14, an image forming apparatus 101 of the present embodiment is an monochrome image forming apparatus including a single visible-image forming unit 50. The image forming apparatus 101 does not include an intermediate transfer belt 15. The image forming apparatus 101 is arranged such that a toner image formed on a photosensitive drum 7 is transferred directly onto a sheet of paper fed from a paper feed cassette device 53. It should be noted that Reference Numeral 51 indicates an automatic document feeder.

The image forming apparatus 101 has a developing device 56 which contains a toner precharging device. As the toner precharging device, the aforementioned ion generating device 1, 28, or 40 is used.

Figure 15:
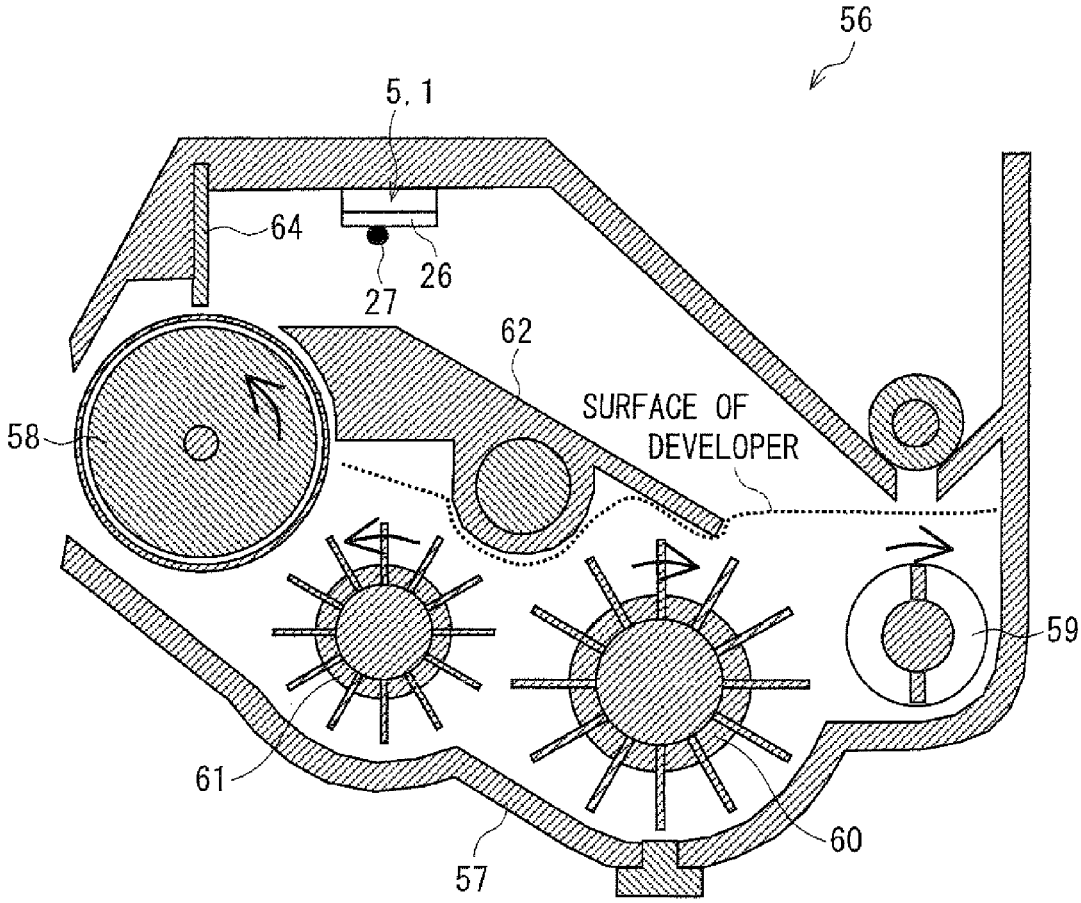
FIG. 15 is an explanatory diagram showing an arrangement of a main part of the developing device in which the ion generating device is used as the toner precharging device.
Figure 16:
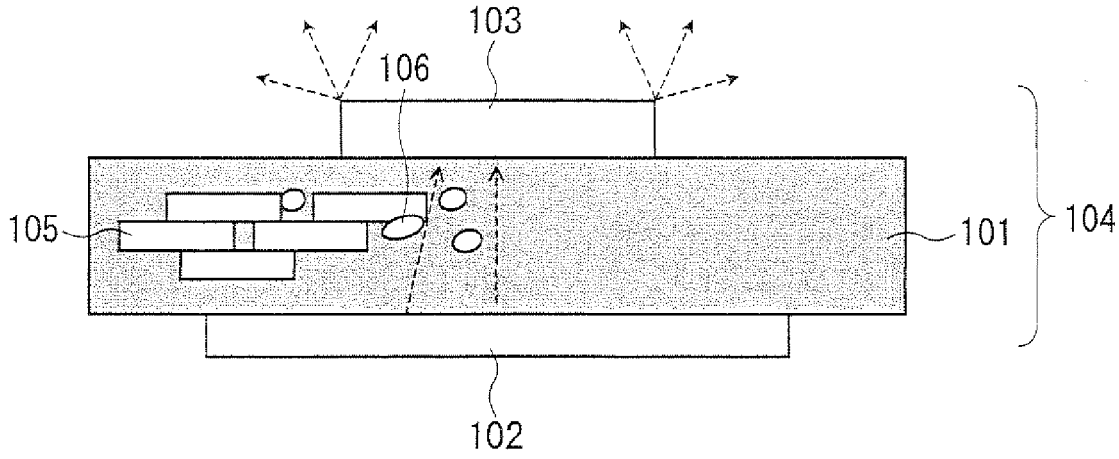
PRIOR ART FIG. 16
FIG. 16 is an explanatory diagram showing an arrangement of a conventional ion generating device.

FIG. 15 shows an arrangement of the developing device 56 in detail. FIG. 15 exemplifies an arrangement in which the ion generating device 1 is used as the toner precharging device. The developing device 56 deals with a two-component developer composed of toner and carrier and has a developer tank 57 in which the developer is contained. Disposed in the developer tank 57 are: a development roller 58, which carries the developer to supply the developer to the photosensitive drum 7; a conveyer roller 59; a mixing roller 60; and a pumping roller 61.

Further, the interior of the developer tank 57 is divided into upper and lower parts by a flow plate 62, and the developer carried by the surface of the development roller and regulated by a layer-thickness regulating member 64 is returned to a space between the conveyer roller 59 and the mixing roller 60 via the flow plate 62.

In the developing device 56 thus arranged, the toner precharging device 5 is disposed near the layer-thickness regulating member 64. The toner precharging device 5 charges the developer, regulated by the layer-thickness regulating member 64, which is returned to the space between the conveyer roller 59 and the mixing roller 60 via the flow plate 62. With this, even if there is a shortage of triboelectric charging entailed by the conveying and stirring functions of the conveyer roller 59, the mixing roller 60, the pumping roller 61, and the like, the amount of charge of the toner can be increased by making up for the shortage.

As described above, an ion generating device of the present invention is an ion generating device for generating ions along with creeping discharge, the ion generating device including: a dielectric material; an inductive electrode disposed on a first surface of the dielectric material; a discharge electrode disposed on a second surface of the dielectric material; an alternating voltage applying section for applying an alternating voltage between the inductive electrode and the discharge electrode; and a DC bias voltage applying section for applying a DC bias voltage to the discharge electrode, the discharge electrode and the dielectric material being provided so as to be movable with respect to each other.

According to the foregoing arrangement, the discharge electrode and the dielectric material are provided so as to be movable with respect to each other. Therefore, in cases where an increase in accumulated amount of discharge time causes the aforementioned deterioration in a portion of the dielectric material in contact with the discharge electrode and the deterioration causes a defect in discharge, the portion of the dielectric material in contact with the discharge electrode can be switched to a new area free of deterioration by changing the position of the discharge electrode with respect to the dielectric material.

This makes it possible to efficiently use a dielectric material that has conventionally been wastefully disposed with an undeteriorated area remaining thereon. This makes it possible to extend the life of a creeping discharge element or an ion generating device while using a dielectric material of the same size. Moreover, this makes it possible to reduce the total cost including maintenance cost for replacing the creeping discharge element and the ion generating device.

The ion generating device of the present invention may be further arranged such that: the inductive electrode is formed on the first surface of the dielectric material; and the discharge electrode is constituted by an electrode member that is narrower than the dielectric material, and is disposed in contact with the second surface of the dielectric material such that both ends of the electrode member in a longitudinal direction of the electrode member are supported by supporting members outside of the dielectric material.

This makes it possible to easily realize the ion generating device of the present invention in which the discharge electrode and the dielectric material are provided so as to be movable with respect to each other.

In this case, the ion generating device of the present invention may be further arranged such that: the dielectric material has a shape of a plate; one of the ends of the electrode member in the longitudinal direction is supported via an elastic member, the ion generating device further comprising a positioning member, provided between at least one of the supporting members supporting the ends of the electrode member and the dielectric material, which holds the electrode member and determines a position of the discharge electrode with respect to the dielectric material, the positioning member being provided with a plurality of hook sections, provided in parallel with one another along a direction orthogonal to the longitudinal direction of the electrode member on the second surface of the dielectric material, on which the electrode member is hung.

According to the foregoing arrangement, the position of the discharge electrode with respect to the plate dielectric material can be switched by a simple operation of switching the hook sections, provided on the positioning member, on which the electrode member constituting the discharge electrode is hung. Further, since one of the ends of the electrode member constituting the discharge electrode is supported via the elastic member, the electrode member has stretchability with respect to the support. This makes it possible to easily switch from one hook section to another.

In this case, the ion generating device of the present invention may be further arranged such that: the dielectric material has a shape of a plate; one of the ends of the electrode member in the longitudinal direction is supported via an elastic member, the ion generating device further comprising a positioning member, provided between at least one of the supporting members supporting the ends of the electrode member and the dielectric material, which holds the electrode member and determines a position of the discharge electrode with respect to the dielectric material, the positioning member including a hook section on which the electrode member is hung, the positioning member being arranged to be movable in a direction orthogonal to the longitudinal direction of the electrode member on the second surface of the dielectric material.

According to the foregoing arrangement, the position of the discharge electrode with respect to the plate dielectric material can be switched by moving the positioning member having the hook section on which the electrode member constituting the discharge electrode has been hung. Also in this case, since one of the ends of the electrode member constituting the discharge electrode is supported via the elastic member, the electrode member has stretchability. Therefore, the positioning member is not inhibited from moving.

Furthermore, when arranged such that the positioning member is movable, the ion generating device can be arranged so as to include a driving mechanism for moving the positioning member. This makes it possible to automatically switch the position of the discharge electrode with respect to the dielectric material.

Further, the ion generating device of the present invention can be characterized in that: the dielectric material and the inductive electrode constitute a rotating roller such that the dielectric material has a cylindrical shape and the inductive electrode is formed on an inner circumferential surface of the dielectric material; and the discharge electrode is disposed on an outer circumferential surface of the dielectric material.

According to the foregoing arrangement, the position of the dielectric material with respect to the discharge electrode can be changed by rotating the rotating roller. Moreover, the cylindrical dielectric material can ensure a larger amount of space than a plate dielectric material, so that a large number of times of switching can be ensured. Therefore, even when a resin film that is inexpensive but more prone to dielectric breakdown than mica material and ceramic is used as a dielectric material, a long-life ion generating device or a long-life creeping discharge element can be obtained.

In this case, the ion generating device is preferably arranged such that one of the ends of the electrode member in the longitudinal direction is supported via an elastic member.

According to the foregoing arrangement, since one of the ends of the electrode member constituting the discharge electrode is supported via the elastic member, the electrode member has stretchability with respect to the support. Therefore, although the rotating roller rotates in contact with the discharge electrode, the rotating roller rotates smoothly.

Furthermore, in the case of such a rotating roller dielectric material, the ion generating device can be arranged so as to include a driving mechanism for rotating the rotating roller. This makes it possible to automatically switch the position of the discharge electrode with respect to the dielectric material.

The rotating roller can be simply arranged, for example, by covering a metal cylinder with an insulating resin tube, by coating an outer circumferential surface of a metal cylinder with ceramic, or by coating an inner circumferential surface of a glass tube with metal.

Further, when arranged so as to include the driving mechanism for moving the positioning member or the driving mechanism for rotating the rotating roller, the ion generating device can be arranged so as to further include control means for accumulating discharge time, and for switching relative positions of the dielectric material and the discharge electrode by controlling the driving mechanism in accordance with the discharge time thus accumulated.

The dielectric material deteriorates as the accumulated amount of discharge time increases. Therefore, by thus controlling the switching in accordance with the accumulated amount of discharge time, for example, by switching the position of the discharge electrode with respect to the dielectric material when the accumulated amount of time reaches a predetermined amount of time, uniform ion generating performance can be ensured for a long period of time without any work done by a service person or a user.

Further, the ion generating device of the present invention is preferably arranged such that the discharge electrode is located below the dielectric material in a vertical direction.

In making effective use of the whole area of the dielectric material by switching the relative positions of the discharge electrode and the dielectric material, it is undesirable that the surface of the dielectric material be contaminated by toner and dust. By thus locating the discharge electrode below the dielectric material in a vertical direction, the surface of the dielectric material in contact with the discharge electrode faces downward in a vertical direction. This makes it possible to prevent the surface of the dielectric material in contact with the discharge electrode from being greatly contaminated by toner and dust, as compared with a case where the discharge electrode is located above the dielectric material in a vertical direction.

Further, since ions and ozone are heavier than air, ions and ozone are likely to flow downward. Therefore, such an arrangement makes it possible to cause generated ions to efficiently reach a charged object and the like.

An image forming apparatus of the present invention is arranged so as to include an ion generating device of the present invention as a pretransfer charging device for giving electric charge to toner carried on a carrier.

By using an ion generating device of the present invention as a pretransfer charging device for giving electric charge to toner carried on a carrier, an image of high quality can be obtained while holding down the total cost.

An image forming apparatus of the present invention is arranged so as to include an ion generating device of the present invention as a toner precharging device for giving electric charge to toner contained in a developing device for developing an electrostatic latent image.

By using an ion generating device of the present invention as a toner precharging device for giving electric charge to toner contained in a developing device for developing an electrostatic latent image, an image of high quality can be obtained while holding down the total cost.

As described above, an ion generating device of the present invention is an ion generating device for generating ions along with creeping discharge, the ion generating device including: a dielectric material; an inductive electrode disposed on a first surface of the dielectric material; a discharge electrode disposed on a second surface of the dielectric material; an alternating voltage applying section for applying an alternating voltage between the inductive electrode and the discharge electrode; and a DC bias voltage applying section for applying a DC bias voltage to the discharge electrode, the discharge electrode being constituted by a wire electrode member disposed in contact with the second surface of the dielectric material such that both ends of the electrode member in a longitudinal direction of the electrode member are supported outside of the dielectric material.

According to the foregoing arrangement, the discharge electrode is constituted by a wire electrode member disposed in contact with the second surface of the dielectric material such that both ends of the electrode member in a longitudinal direction of the electrode member are supported outside of the dielectric material. This makes it easier to manufacture a creeping discharge element and an ion generating device as compared with a conventional arrangement in which a discharge electrode has been formed directly on a surface of a dielectric material with use of a photolithographic technique. This makes it possible to reduce the cost of manufacturing.

Furthermore, the discharge electrode is in the shape of a wire. This makes it easy to efficiently cause creeping discharge entirely on an outer circumferential surface of the discharge electrode. As compared with a conventional arrangement in which a discharge electrode made by patterning an electrode film is provided, it becomes possible to increase the amount of discharge with respect to the alternating voltage applied between the discharge electrode and the inductive electrode. This makes it possible to decrease the alternating voltage applied between the discharge electrode and the inductive electrode. This makes it possible to save electric power and to extend the life of the ion generating device or the creeping discharge element by inhibiting the dielectric material from deteriorating.

Further, the discharge electrode is not formed directly on the dielectric material. This makes it easy to change the relative positions of the dielectric material and the discharge electrode. This makes it possible to further extend the life of the ion generating device or the creeping discharge element with efficient use of the dielectric material, for example, by switching the position of the discharge electrode with respect to the dielectric material.

Further, the ion generating device of the present invention is preferably arranged such that: the dielectric material has a shape of a flat plate, and is curved such that a surface of the dielectric material surface makes contact with the discharge electrode is convex.

The dielectric material is a very thin plate member. Therefore, the dielectric material may be deformed. If the dielectric material is warped in such a manner that the surface of the dielectric material in contact with the discharge electrode is concaved across a central part of the longitudinal direction, the dielectric material and the discharge electrode are prevented from making contact with each other entirely in the longitudinal direction.

On the other hand, the dielectric material is shaped from the beginning so as to be warped in such a manner that the surface of the dielectric material in contact with the discharge electrode is convexed across the central part of the longitudinal direction. This makes it possible to bring the discharge electrode into close contact with the dielectric material entirely.

Further, the ion generating device of the present invention can be further characterized in that one of the ends of the electrode member in the longitudinal direction is supported via an elastic member.

Such an arrangement imparts stretchability to the discharge electrode, so that the discharge electrode does not become loose and can make contact with the dielectric material with tension.

Further, the ion generating device of the present invention can be further characterized in that the electrode member has a circular cross-section as cut from a direction orthogonal to an axial direction of the electrode member.

The wire electrode member has a circular cross-section. This makes it possible to effectively cause discharge entirely on an outer circumferential surface of the electrode member. Moreover, in the case of the wire electrode member having a circular cross-section, as the curvature is made smaller, the amount of discharge can be made larger. Therefore, the smaller the diameter is, the lower the applied voltage can be.

Especially in this case, it is preferable that the diameter of the wire electrode member fall within a range of not less than 20 μm to not more than 100 μm. When the diameter is smaller than 20 μm, the discharge efficiency increases, but the mechanical strength becomes insufficient. This causes problems in terms of life. On the other hand, when the diameter exceeds 100 μm, the discharge efficiency decreases, and the strength of a member for fixing the discharge electrode is required.

Further, it is preferable that the electrode member have a discharge current of more than 5 μA in absolute value. For example, in cases where the ion generating device of the present invention is used as the after-mentioned pretransfer charging device for supplementing the amount of discharge of toner existing on the intermediate transfer belt, a discharge current of more than 5 μA in absolute value allows the toner on the intermediate transfer belt to be charged so as to have an amount of charge of not less than −20 μq (in absolute value). This makes is possible to realize high transfer efficiency.

Further, the ion generating device of the present invention can be further characterized in that the electrode member is plated with gold. This makes it possible to extend the life of the discharge electrode and to increase the strength of the discharge electrode.

The ion generating device of the present invention is preferably arranged such that the dielectric material is made of mica paper made by joining pieces of mica on top of each other with resin. Mica paper is preferable in terms of price, insulating properties, and processability together with such advantages that mica paper is more inexpensive than raw mica, that mica paper is more processable than ceramic, and that mica paper is more resistant to dielectric breakdown than a resin film.

An image forming apparatus of the present invention is arranged so as to include an ion generating device of the present invention as a pretransfer charging device for giving electric charge to toner carried on a carrier.

By using an ion generating device of the present invention as a pretransfer charging device for imparting appropriate charging properties to toner before a transfer, an image of high quality can be obtained while holding down the cost of manufacturing and the running cost.

An image forming apparatus of the present invention is arranged so as to include an ion generating device of the present invention as a toner precharging device for giving electric charge to toner contained in a developing device for developing an electrostatic latent image.

By using an ion generating device of the present invention as a toner precharging device for making up for a defect in charging of toner contained in a developing device, an image of high quality can be obtained while holding down the cost of manufacturing and the running cost.

The present invention is not limited to the description of the embodiments above, but may be altered by a skilled person within the scope of the claims. An embodiment based on a proper combination of technical means disclosed in different embodiments is encompassed in the technical scope of the present invention.

Numerical values falling outside the ranges indicated herein but falling within rational ranges that comply with the gist of the present invention are of course encompassed in the present invention.

What is claimed is:

1. An ion generating device for generating ions along with creeping discharge, the ion generating device comprising:

a dielectric material;

an inductive electrode disposed on a first surface of the dielectric material;

a discharge electrode disposed on a second surface of the dielectric material;

an alternating voltage applying section for applying an alternating voltage between the inductive electrode and the discharge electrode; and a DC bias voltage applying section for applying a DC bias voltage to the discharge electrode, the discharge electrode and the dielectric material being provided so as to be movable with respect to each other.

2. The ion generating device as set forth in claim 1, wherein:

the inductive electrode is formed on the first surface of the dielectric material; and the discharge electrode is constituted by an electrode member that is narrower than the dielectric material, and is disposed in contact with the second surface of the dielectric material such that both ends of the electrode member in a longitudinal direction of the electrode member are supported by supporting members outside of the dielectric material.

3. The ion generating device as set forth in claim 2, wherein:

the dielectric material has a shape of a plate;

one of the ends of the electrode member in the longitudinal direction is supported via an elastic member, the ion generating device further comprising a positioning member, provided between at least one of the supporting members supporting the ends of the electrode member and the dielectric material, which holds the electrode member and determines a position of the electrode member with respect to the dielectric material, the positioning member being provided with a plurality of hook sections, provided in parallel with one another along a direction orthogonal to the longitudinal direction of the electrode member on the second surface of the dielectric material, on which the electrode member is hung.

4. The ion generating device as set forth in claim 2, wherein:

the dielectric material has a shape of a plate;

one of the ends of the electrode member in the longitudinal direction is supported via an elastic member, the ion generating device further comprising a positioning member, provided between at least one of the supporting members supporting the ends of the electrode member and the dielectric material, which holds the electrode member and determines a position of the electrode member with respect to the dielectric material, the positioning member including a hook section on which the electrode member is hung, the positioning member being arranged to be movable in a direction orthogonal to the longitudinal direction of the electrode member on the second surface of the dielectric material.

5. The ion generating device as set forth in claim 4, further comprising a driving mechanism for moving the positioning member.

6. The ion generating device as set forth in claim 2, wherein:

the dielectric material and the inductive electrode constitute a rotating roller such that the dielectric material has a cylindrical shape and the inductive electrode is formed on an inner circumferential surface of the dielectric material; and the discharge electrode is disposed on an outer circumferential surface of the dielectric material.

7. The ion generating device as set forth in claim 6, wherein one of the ends of the electrode member in the longitudinal direction is supported via an elastic member.

8. The ion generating device as set forth in claim 6, further comprising a driving mechanism for rotating the rotating roller.

9. The ion generating device as set forth in claim 6, wherein the rotating roller is arranged by covering a metal cylinder with an insulating resin tube.

10. The ion generating device as set forth in claim 6, wherein the rotating roller is arranged by coating an outer circumferential surface of a metal cylinder with ceramic.

11. The ion generating device as set forth in claim 6, wherein the rotating roller is arranged by coating an inner circumferential surface of a glass tube with metal.

12. The ion generating device as set forth in claim 5, further comprising control means for accumulating discharge time, and for switching relative positions of the dielectric material and the discharge electrode by controlling the driving mechanism in accordance with the discharge time thus accumulated.

13. The ion generating device as set forth in claim 8, further comprising control means for accumulating discharge time, and for switching relative positions of the dielectric material and the discharge electrode by controlling the driving mechanism in accordance with the discharge time thus accumulated.

14. The ion generating device as set forth in claim 1, wherein the discharge electrode is located below the dielectric material in a vertical direction.

15. An image forming apparatus comprising, as a pretransfer charging device for giving electric charge to toner carried on a carrier, an ion generating device for generating ions along with creeping discharge, the ion generating device including:

a dielectric material;

an inductive electrode disposed on a first surface of the dielectric material;

a discharge electrode disposed on a second surface of the dielectric material;

an alternating voltage applying section for applying an alternating voltage between the inductive electrode and the discharge electrode; and a DC bias voltage applying section for applying a DC bias voltage to the discharge electrode, the discharge electrode and the dielectric material being provided so as to be movable with respect to each other.

16. An image forming apparatus comprising, as a toner precharging device for giving electric charge to toner contained in a developing device for developing an electrostatic latent image, an ion generating device for generating ions along with creeping discharge, the ion generating device including:

a dielectric material;

an inductive electrode disposed on a first surface of the dielectric material;

a discharge electrode disposed on a second surface of the dielectric material;

an alternating voltage applying section for applying an alternating voltage between the inductive electrode and the discharge electrode; and a DC bias voltage applying section for applying a DC bias voltage to the discharge electrode, the discharge electrode and the dielectric material being provided so as to be movable with respect to each other.

17. An ion generating device for generating ions along with creeping discharge, the ion generating device comprising:

a dielectric material;

an inductive electrode disposed on a first surface of the dielectric material;

a discharge electrode disposed on a second surface of the dielectric material;

an alternating voltage applying section for applying an alternating voltage between the inductive electrode and the discharge electrode; and a DC bias voltage applying section for applying a DC bias voltage to the discharge electrode, the discharge electrode being constituted by a wire electrode member disposed in contact with the second surface of the dielectric material such that both ends of the electrode member in a longitudinal direction of the electrode member are supported outside of the dielectric material.

18. The ion generating device as set forth in claim 17, wherein the dielectric material has a shape of a flat plate, and is curved such that a surface of the dielectric material which makes contact with the discharge electrode is convex.

19. The ion generating device as set forth in claim 17, wherein one of the ends of the electrode member in the longitudinal direction is supported via an elastic member.

20. The ion generating device as set forth in claim 17, wherein the electrode member has a circular cross-section as cut from a direction orthogonal to an axial direction of the electrode member.

21. The ion generating device as set forth in claim 20, wherein the electrode member has a diameter of not less than 20 μm to not more than 100 μm.

22. The ion generating device as set forth in claim 17, wherein the electrode member is plated with gold.

23. The ion generating device as set forth in claim 17, wherein the dielectric material is made of mica paper made by joining pieces of mica on top of each other with resin.

24. The ion generating device as set forth in claim 21, wherein the electrode member has a discharge current of more than 5 μA in absolute value.

25. An image forming apparatus comprising, as a pretransfer charging device for giving electric charge to toner carried on a carrier, an ion generating device, for generating ions along with creeping discharge, the ion generating device including:

a dielectric material;

an inductive electrode disposed on a first surface of the dielectric material;

a discharge electrode disposed on a second surface of the dielectric material;

an alternating voltage applying section for applying an alternating voltage between the inductive electrode and the discharge electrode; and a DC bias voltage applying section for applying a DC bias voltage to the discharge electrode, the discharge electrode being constituted by a wire electrode member disposed in contact with the second surface of the dielectric material such that both ends of the electrode member in a longitudinal direction of the electrode member are supported outside of the dielectric material.

26. An image forming apparatus comprising, as a toner precharging device for giving electric charge to toner contained in a developing device for developing an electrostatic latent image, an ion generating device for generating ions along with creeping discharge, the ion generating device including:

a dielectric material;

an inductive electrode disposed on a first surface of the dielectric material;

a discharge electrode disposed on a second surface of the dielectric material;

an alternating voltage applying section for applying an alternating voltage between the inductive electrode and the discharge electrode; and a DC bias voltage applying section for applying a DC bias voltage to the discharge electrode, the discharge electrode being constituted by a wire electrode member disposed in contact with the second surface of the dielectric material such that both ends of the electrode member in a longitudinal direction of the electrode member are supported outside of the dielectric material.

* * * * *